US007203416B2

(12) United States Patent
Craw et al.

(10) Patent No.: US 7,203,416 B2
(45) Date of Patent: Apr. 10, 2007

(54) VENTILATING AND HEATING APPARATUS WITH HEATER SHIELDED BY TAPERED DISCHARGE DUCT

(75) Inventors: Gary J. Craw, Delafield, WI (US); Daniel L. Karst, Beaver Dam, WI (US); Christopher J. Nemacheck, Sussex, WI (US); Kenneth J. Jonas, Mequon, WI (US)

(73) Assignee: Broan-NuTone LLC, Hartford, WI (US)

( * ) Notice: Subject to any disclaimer, the term of this patent is extended or adjusted under 35 U.S.C. 154(b) by 0 days.

(21) Appl. No.: 10/719,694

(22) Filed: Nov. 21, 2003

(65) Prior Publication Data

US 2005/0111840 A1 May 26, 2005

(51) Int. Cl.
*F24D 5/10* (2006.01)

(52) U.S. Cl. ..... 392/350; 392/360

(58) Field of Classification Search ..... 392/360, 392/363–369, 379–383, 350
See application file for complete search history.

(56) References Cited

U.S. PATENT DOCUMENTS

| | | | | | |
|---|---|---|---|---|---|
| 1,030,028 | A | | 6/1912 | Stampahar et al. | |
| 1,106,334 | A | * | 8/1914 | Menden | 219/202 |
| 1,232,598 | A | * | 7/1917 | Norstrom et al. | 392/360 |
| 1,395,883 | A | | 11/1921 | Kling et al. | |
| 1,429,130 | A | * | 9/1922 | Dutton | 392/369 |
| 1,532,635 | A | | 4/1925 | Osbun | |
| 1,534,571 | A | * | 4/1925 | Conning | 392/367 |
| 1,620,767 | A | * | 3/1927 | Axel | 392/367 |
| 1,644,595 | A | * | 10/1927 | Karg | 126/67 |
| 1,660,052 | A | * | 2/1928 | Shepherd | 392/349 |
| 1,749,039 | A | * | 3/1930 | Lincecum | 392/367 |
| 1,895,642 | A | | 1/1933 | Preble | |
| 1,941,450 | A | | 1/1934 | Sylvan | |
| 1,982,139 | A | * | 11/1934 | Kercher | 392/363 |
| 1,991,280 | A | * | 2/1935 | Hynes | 392/349 |
| 2,015,982 | A | * | 10/1935 | Ernst | 392/365 |
| 2,019,867 | A | | 11/1935 | Nelson | |
| 2,108,283 | A | | 2/1938 | Drew et al. | |
| 2,189,008 | A | | 2/1940 | Kurth | |

(Continued)

FOREIGN PATENT DOCUMENTS

| | | | | |
|---|---|---|---|---|
| BE | 648597 | | 9/1964 | |
| CA | 679120 | * | 1/1964 | 392/368 |
| FR | 1234767 | | 10/1960 | |
| FR | 1514616 | * | 2/1968 | 392/360 |

OTHER PUBLICATIONS

Spartan Electric Company, Direct Drive Whole House Fans Publication.

(Continued)

*Primary Examiner*—Thor Campbell
(74) *Attorney, Agent, or Firm*—Michael Best & Friedrich LLP

(57) ABSTRACT

The invention provides a ventilating and heating apparatus for installation in a building structure. In some embodiments, the apparatus includes a main housing in which is located a ventilating fan assembly and a heater fan assembly having a heater and a discharge duct terminating in a discharge outlet, wherein the heater is located within and connected to the discharge duct of the heater fan assembly. The heater can be shielded from the discharge outlet by at least one interior wall of the discharge duct. In some embodiments, the discharge duct can have a tapered portion approaching the discharge outlet. In some embodiments, a discharge aperture of a cover is recessed with respect to the discharge outlet of a fan housing.

53 Claims, 8 Drawing Sheets

U.S. PATENT DOCUMENTS 2,220,127 A 11/1940 Slayter
2,263,174 A * 11/1941 Klauber ..... 392/363
2,278,581 A 4/1942 Dexter
2,325,657 A 8/1943 Burkness
2,445,250 A * 7/1948 Steingruber ..... 392/376
2,483,377 A 9/1949 Young
2,562,600 A 7/1951 Cadwell et al.
2,668,491 A 2/1954 Gerlitz
2,673,514 A 3/1954 Hanks
2,683,796 A * 7/1954 Koff ..... 392/356
2,710,573 A 6/1955 Marker
2,780,981 A 2/1957 Miller
2,875,678 A 3/1959 Sheperd
2,911,900 A 11/1959 Rudy
2,963,956 A 12/1960 Hill
2,987,258 A 6/1961 North
3,002,676 A 10/1961 Papsdorf
3,025,382 A * 3/1962 Eisele ..... 392/350
3,045,579 A 7/1962 Jenn et al.
3,059,447 A * 10/1962 Brugler ..... 62/183
3,064,548 A 11/1962 Field
3,068,341 A 12/1962 Ortiz et al.
3,075,335 A 1/1963 Bandlow
3,101,662 A 8/1963 Alldritt
3,211,080 A 10/1965 Rader
3,212,425 A 10/1965 Hazen
3,249,037 A 5/1966 Stalker
3,250,063 A 5/1966 Andrews
3,276,597 A 10/1966 Mesek et al.
3,309,503 A * 3/1967 Dow et al. ..... 392/369
3,326,112 A 6/1967 Sadlow et al.
3,391,689 A 7/1968 Roger
3,438,180 A 4/1969 Klouda
3,577,710 A 5/1971 Feldman
3,606,593 A 9/1971 Steiner
3,630,007 A 12/1971 Neumann
3,636,306 A 1/1972 Bumpus
3,665,838 A 5/1972 Shepherd
3,692,977 A 9/1972 Duhamel et al.
3,698,833 A 10/1972 Cann et al.
3,732,030 A 5/1973 Mullings
3,743,439 A 7/1973 Cann
3,785,271 A 1/1974 Joy
3,788,207 A 1/1974 Doherty, II
3,861,894 A 1/1975 Marsh
3,926,537 A 12/1975 Piper
3,952,638 A 4/1976 Felter et al.
4,073,597 A 2/1978 Barnhart et al.
4,115,082 A 9/1978 Newell
4,141,703 A 2/1979 Mulchi
4,252,547 A 2/1981 Johnson
4,319,898 A 3/1982 Maierhofer
4,335,647 A 6/1982 Timmons
4,336,749 A 6/1982 Barnhart et al.
4,382,440 A 5/1983 Kapp et al.
4,385,550 A 5/1983 Steiner et al.
4,385,911 A 5/1983 Popeil et al.
4,406,216 A 9/1983 Hott et al.
4,510,851 A 4/1985 Sarnosky et al.
4,594,940 A 6/1986 Wolbrink et al.
4,610,705 A 9/1986 Sarnosky et al.
4,628,802 A 12/1986 Steiner
4,630,182 A 12/1986 Moroi et al.
4,867,640 A 9/1989 Penlesky et al.
5,664,872 A 9/1997 Spearman et al.
5,879,232 A 3/1999 Luter, II et al.
5,918,972 A 7/1999 Van Belle
5,934,783 A 8/1999 Yoshikawa
6,027,406 A 2/2000 Yazici
6,095,671 A 8/2000 Hutain
6,261,175 B1 7/2001 Larson et al.
6,327,427 B1 * 12/2001 Burkett ..... 392/369
6,340,237 B1 1/2002 Koga et al.
6,488,579 B2 12/2002 Larson et al.

OTHER PUBLICATIONS

Emerson Environmental Products, Whole House Fan and Shutter System Owners Manual, Dec. 1982.

* cited by examiner

VENTILATING AND HEATING APPARATUS WITH HEATER SHIELDED BY TAPERED DISCHARGE DUCT

BACKGROUND OF THE INVENTION

Some existing ventilating units are designed for heating a room using radiant heat from an electric heater, and for ventilating the room using a fan moving air through the unit. In some cases, the fan also functions to carry away heat generated by the heater in order to avoid overheating the heater and other components of the ventilating unit. In some cases, the ventilating unit also includes a lighting assembly.

SUMMARY OF THE INVENTION

Some embodiments of the present invention provide a ventilating and heating apparatus for installation in a building structure, wherein the apparatus comprises a main housing, a fan housing positioned in the main housing and having a discharge duct terminating in a discharge outlet, a fan located within the fan housing and rotatable about an axis, and a heater located in the discharge duct and operatively coupled to and shielded from a discharge outlet by at least one interior wall of the discharge duct.

In another aspect of the present invention, a ventilating and heating apparatus for installation in a building structure is provided, and includes a main housing, a fan housing positioned in the main housing and having a discharge duct terminating in a discharge outlet, and a heater positioned in the discharge duct and operable to heat airflow passing through the discharge duct, wherein the discharge duct has a first cross-sectional area taken along a plane normal to the discharge duct at the heater, the discharge outlet has a second cross-sectional area taken along a plane normal to airflow passing through the discharge outlet, and the second cross-sectional area is less than the first cross-sectional area.

In yet another aspect of the present invention, a ventilating and heating apparatus for installation in a building structure is provided, and includes a main housing, a fan housing positioned in the main housing and having a discharge duct terminating in a discharge outlet, a heater secured within the discharge duct of the fan housing, and a cover coupled to and substantially closing an open side of the main housing, wherein the cover has a discharge aperture defined therein and in fluid communication with the discharge outlet of the fan housing, and the discharge aperture of the cover has a larger cross-sectional area than the discharge outlet of the fan housing such that edges of the cover defining a periphery of the discharge aperture are recessed with respect to the discharge outlet of the fan housing.

Other features and aspects of the present invention will become apparent to those skilled in the art upon review of the following detailed description, claims and drawings.

BRIEF DESCRIPTION OF THE DRAWINGS

In the drawings, wherein like reference numerals indicate like parts.

Figure 1:
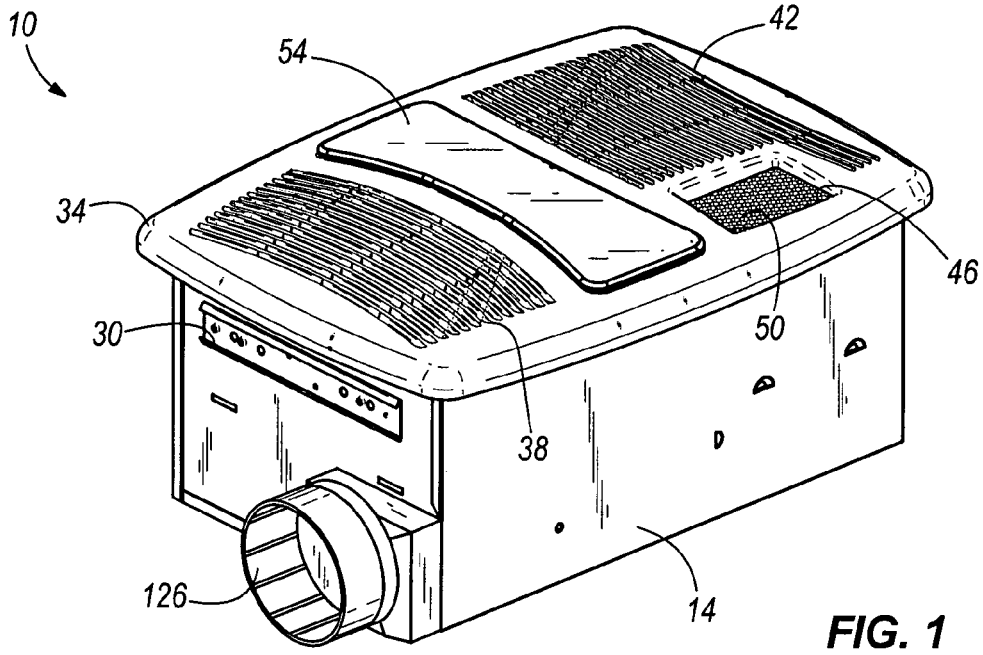
FIG. 1 is a perspective view of a ventilating and heating apparatus according to an exemplary embodiment of the present invention.
Figure 2:
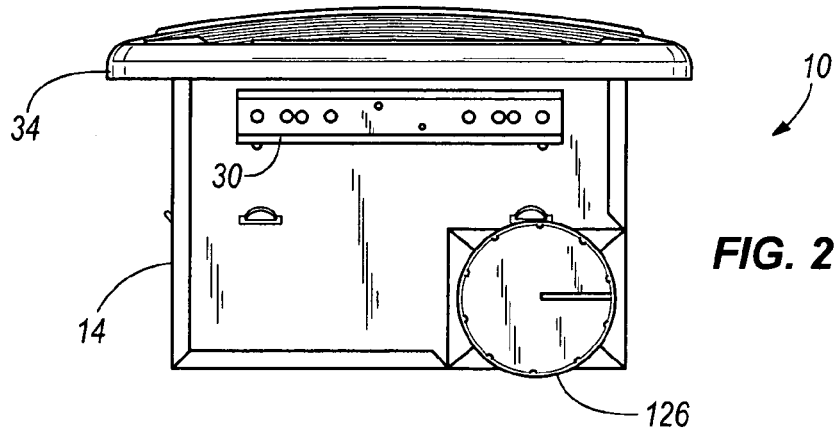
FIG. 2 is an end view of the apparatus shown in FIG. 1.
Figure 3:
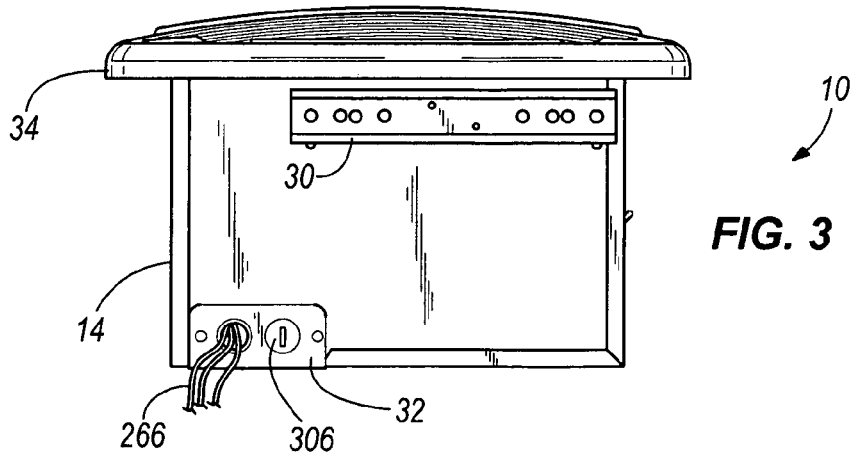
FIG. 3 is an opposite end view of the apparatus shown in FIG. 2.

Before the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. Furthermore, terms such as "front," "rear," "top," "bottom," and the like are only used to describe elements as they relate to one another, but are in no way meant to recite specific orientations of the apparatus, to indicate or imply necessary or required orientations of the apparatus, or to specify how the invention described herein will be used, mounted, displayed, or positioned in use.

DETAILED DESCRIPTION

With reference to the figures, and more particularly to FIGS. 1–7, an exemplary ventilating and heating apparatus is shown generally at 10. The apparatus 10 includes several components and devices that perform various functions. In some embodiments of the present invention, the apparatus 10 generally includes a main housing 14 for housing various components of the apparatus 10, a ventilation assembly 18 for moving air into and through the apparatus 10, a lighting assembly 22 for providing illumination, a heating assembly 26 for heating an airflow through the apparatus 10, at least one mounting bracket 30 for mounting the apparatus 10 to one or more surfaces or support structures, and a junction box or panel 32 for routing or housing electrical wiring. Various embodiments of the present invention can employ any one or more of these elements and structures (and any combination thereof) as desired. By way of example only, some embodiments of the present invention employ a ventilating assembly 18 and a heating assembly 26 without having a lighting assembly 22, or have a heating assembly 26 with or without a lighting assembly 22 or a ventilating assembly. Accordingly, the various features and elements of the present invention described herein and illustrated in the figures can be employed in assemblies having different structures and functional capabilities.

In some embodiments, the apparatus 10 is employed to ventilate, illuminate, and/or heat any room, area or space. By way of example only, in some embodiments the apparatus 10 is employed to ventilate a room, area or space independently of heating the room, area or space. In other embodiments, the apparatus 10 is employed to ventilate a room, area or space independently of illuminating the room, area or space. In still other embodiments, the apparatus 10 is employed to illuminate a room, area or space independently of heating the room, area or space. With reference to the exemplary embodiment of FIGS. 1–16, the lighting assembly 22 can illuminate a room, the ventilating assembly 18 can draw air from the room and into the main housing 14, and the heating assembly 26 can draw air from the room, heat the air, and discharge the air back into the room at an elevated temperature.

The main housing 14 can be formed of any material desired, and in some embodiments is constructed of a material capable of withstanding varying temperatures (i.e., to withstand any heat radiated and/or conducted from the lighting assembly 22, ventilating assembly 18, heating assembly 26, and/or other components of the apparatus 10). The material of the main housing 14 can also be selected to provide structural integrity to the apparatus 10. In some embodiments, the main housing 14 is formed of sheet metal. In other embodiments, the main housing 14 is instead formed of a ceramic or a polymer material. Such material can be selected to have a relatively high melting temperature and/or glass transition temperature as needed. The main housing 14 can have any shape, including a rectangular box-like shape as shown in FIGS. 1–7, a oval shape, a hemispherical or spherical shape, a pyramidal shape, and the like. The main housing 14 can form a base or frame for the apparatus 10, thereby providing points and areas of attachment for other components of the apparatus 10. As shown in FIGS. 8–14 for example, the main housing 14 can provide places of attachment for the ventilating assembly 18, the heating assembly 26, the mounting brackets 30, and/or the junction box or panel 32.

In some embodiments, the main housing 14 of the apparatus 10 can include or be used in conjunction with one or more mounting brackets 30 for mounting the apparatus 10 to a variety of support structures or surfaces. Any number and type of mounting brackets 30 known to those skilled in the art can be used with the apparatus 10. The illustrated exemplary embodiment employs two mounting brackets 30 formed of sheet metal and having a C-shaped channel structure. The C-shaped mounting brackets 30 of the illustrated embodiment can be used in combination with mating rails (not shown) coupled to support structures or surfaces. Although the mounting bracket(s) 30 can be located in any position(s) on the main housing 14 suitable to support the apparatus 10 with respect to surrounding structure, in some cases the mounting brackets 30 are attached to opposite side walls of the main housing 14 in any conventional manner. Alternatively, the main housing 14 can be mounted directly (via any of a variety of fasteners and fastening methods commonly known to those in the art) to a support structure or surface, thereby eliminating the need for mounting brackets 30.

Some embodiments of the apparatus 10 include a cover 34 coupled to the main housing 14 to close the main housing 14. The illustrated exemplary main housing 14 has a generally box-like shape with an open end. The illustrated cover 34 has a generally rectangular shape, but can instead take any other shape matching or substantially matching the shape of the main housing 14. In other embodiments, the cover 34 can have a shape different than that of the main housing 14 it covers.

The cover 34 can be shaped to define a receptacle therein, such as by a wall or skirt running around the periphery of the cover 34 (see, for example, FIGS. 1–3, 6–8 of the illustrated exemplary embodiment). In such cases, the cover 34 can have an open side that is placed over an open side of the housing 14. The cover 34 can have a depth of any size, and therefore can define any amount of the depth of the apparatus 10.

As described above, the cover 34 can be positioned over an open side of the main housing 14. The cover 34 can thereby close any amount of the main housing 14. In some embodiments (e.g., the embodiment illustrated in FIGS. 1–16), an open end of the main housing 14 is shaped and dimensioned to be received within an open end of the cover 34. If desired, the cover can be fastened or otherwise secured to the main housing 14 in any suitable manner, such as by one or more snap-fit features or elements on the cover 34 and/or main housing 14, by any of a variety of conventional fasteners (e.g., screws, bolts, rivets, pins, clamps, and the like), by welding, adhesive or cohesive bonding material, by a combination thereof, and the like. In such cases, the main housing 14 can be provided with one or more lips, flared edges, flanges, or other features to which the cover 34 can attach. By way of example only, the main housing 14 in the illustrated exemplary embodiment has peripheral flanges 35 to which the cover 34 can attach by conventional fasteners, by snap-fitting over the flanges 35, or in any other manner. In other embodiments, the cover 34 can be shaped and dimensioned to be received within the main housing 14 for attachment thereto in any of the manners described above. In any of the main housing and cover configurations, the main housing 14 and/or the cover 34 can be provided with apertures through which fasteners can be passed to secure the cover 34 to the main housing 14.

Figure 4:
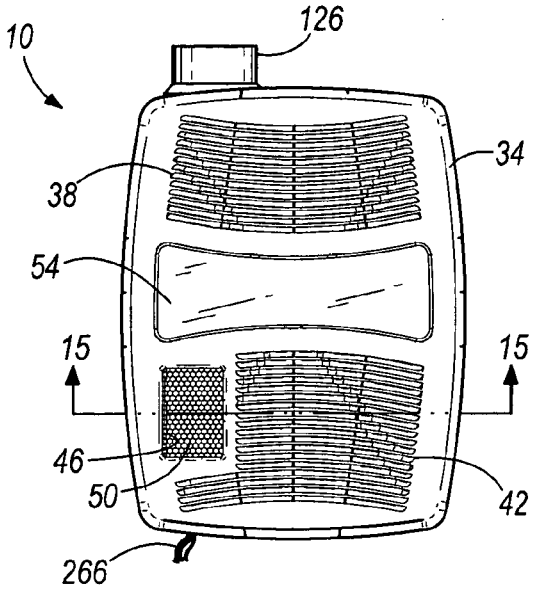
FIG. 4 is a top view of the apparatus shown in FIG. 1.
Figure 5:
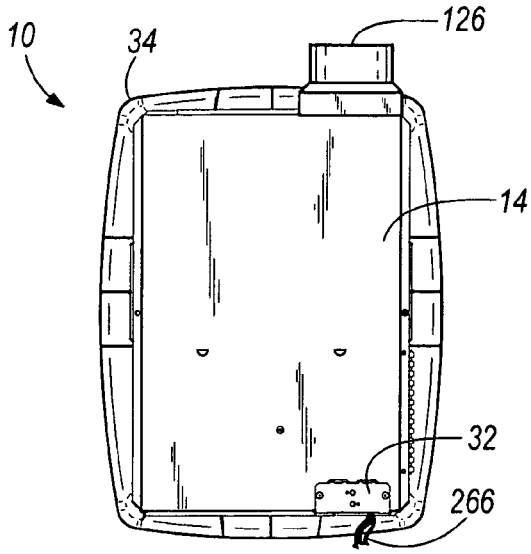
FIG. 5 is a bottom view of the apparatus shown in FIG. 1.
Figure 6:
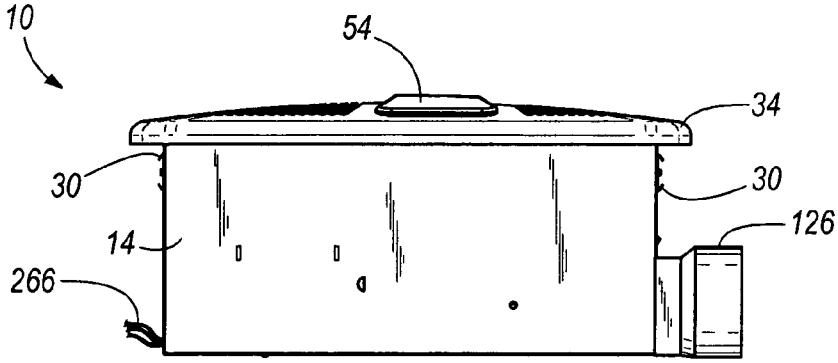
FIG. 6 is a side view of the apparatus shown in FIG. 1.
Figure 7:
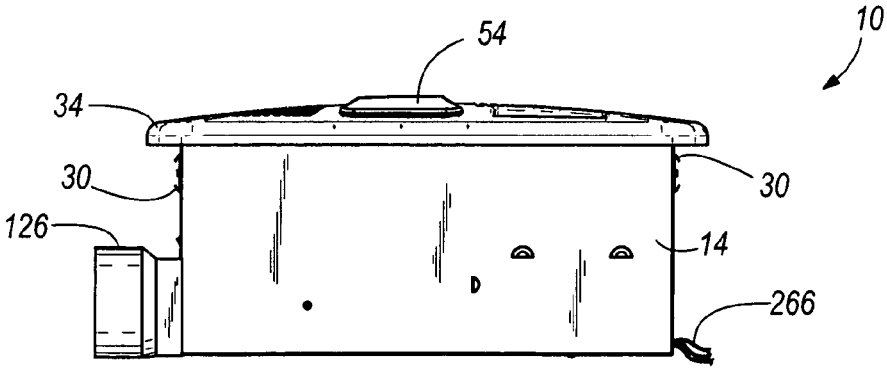
FIG. 7 is an opposite side view of the apparatus shown in FIG. 6.
Figure 8:
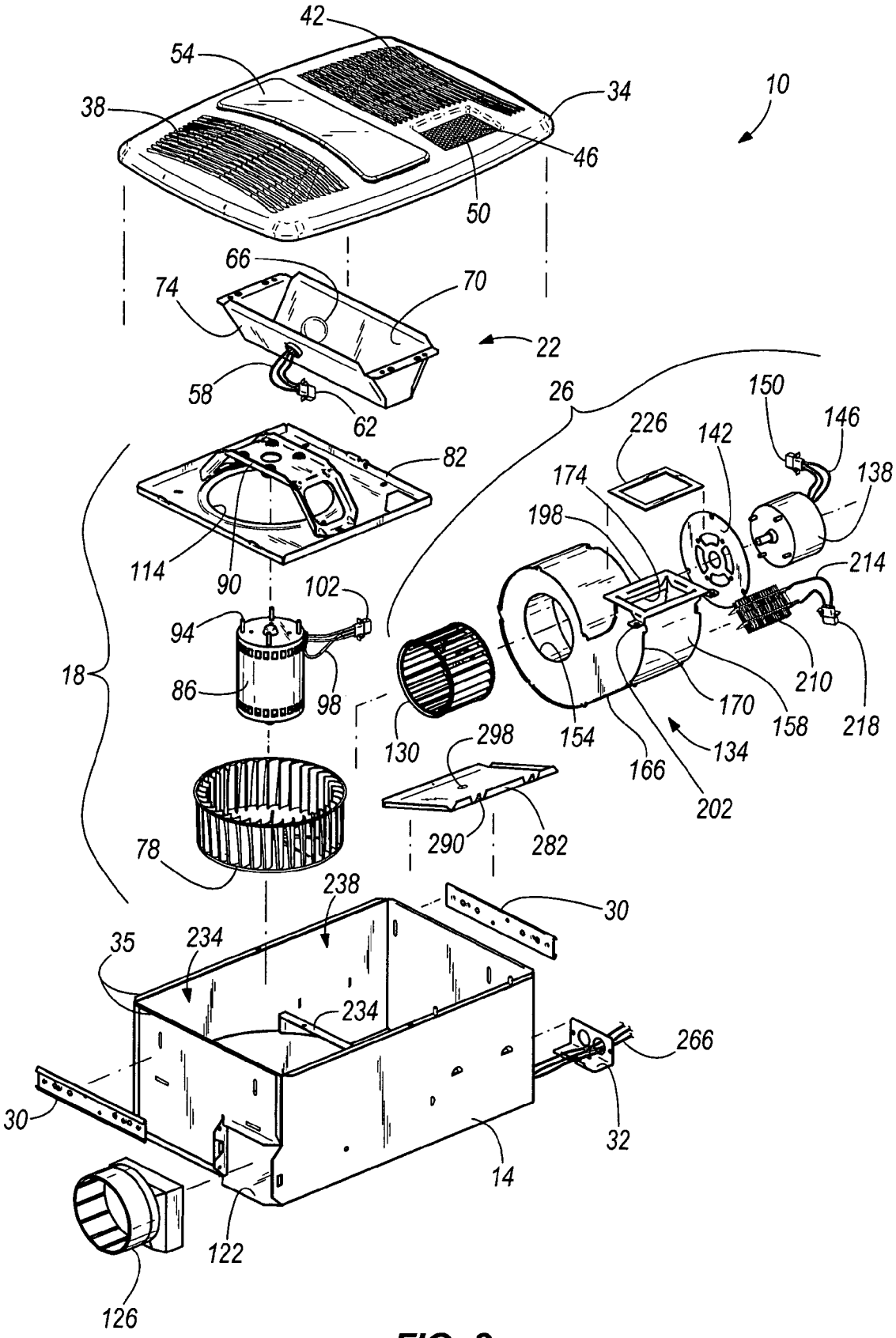
FIG. 8 is an exploded perspective view of the apparatus shown in FIG. 1.

With reference to FIGS. 1, 4, and 8, the cover 34 can include a first set of apertures, or louvers 38 collectively defining a ventilation inlet into the main housing 14. The louvers 38 can be located anywhere on the cover 34 depending at least partially upon the airflow path(s) available within the main housing 14 from the louvers 38 to the ventilating assembly 18. In some embodiments, the louvers 38 are located in a part of the cover 34 covering the ventilating assembly 18. The first set of louvers 38 can guide inlet air to the ventilating assembly 18, which is operable to generate a ventilating airflow that draws air from any room, area, and/or space into the main housing 14. From the main housing 14, the ventilating assembly 18 is operable to discharge the airflow to another location.

The cover 34 can also includes a second set of apertures, or louvers 42 collectively defining another ventilation inlet into the main housing 14. The second set of louvers 42 can be located anywhere on the cover 34 depending at least partially upon the airflow path(s) available within the main housing 14 from the second set of louvers 42 to the heater assembly 26. By way of example only, the second set of louvers 42 in the illustrated exemplary embodiment is located at an end of the cover 34 and main housing 14 opposite the first set of louvers 38. In some embodiments, the second set of louvers 42 is located in a part of the cover 34 covering the heater assembly 26. The second set of louvers 42 can guide inlet air to the heater assembly 26, which is operable to generate heated airflow in a room, area, and/or space.

The cover 34 can have a single set of louvers supplying air to the ventilating assembly 18 and to the heater assembly 26, can have two or more sets of louvers supplying air to both assemblies 18, 26, or can have one or more dedicated sets of louvers for each assembly 18, 26.

In some embodiments, the cover 34 has a discharge aperture 46 for discharging heated air from the apparatus 10. The discharge aperture 46 can be located anywhere on the cover 34, depending at least partially upon the location of the heater assembly 26 and the outlet thereof. By way of example only, the discharge aperture 46 in the illustrated embodiment is adjacent the second set of louvers 42. When coupled to the main housing 14, the discharge aperture 46 in the cover 34 can corresponds with and be in fluid communication with the heating assembly 26 to receive discharged and heated airflow therethrough. If desired, a screen 50 can be coupled to the cover 34 (and/or to the discharge outlet 174 of the heating assembly 26, described in greater detail below) such that the heated airflow is made to pass through the screen 50. In some embodiments, the screen 50 has a sufficient density (e.g., the density of a mesh or honeycomb screen) such that the heating assembly 26 cannot be readily viewed by an observer viewing the exterior of the apparatus 10. In addition, the screen 50 can be made from any of an number of different metals and other heat-resistant materials, and can employ any of a number of different patterns and/or configurations.

As described above, some embodiments of the apparatus 10 includes a lighting assembly 22. As shown in FIG. 8, the lighting assembly 22 can be coupled to the main housing 14 via the cover 34. Alternatively, the lighting assembly 22 can be secured to one or more walls of the main housing 14 or other structural components of the apparatus 10 in any suitable manner.

The cover 34 can include a lens 54 coupled thereto for diffusing light emitted by the lighting assembly 22. In some embodiments of the apparatus 10, the lens 54 can be releasably coupled to the cover 34 by any of a number of known methods (e.g., snap-fitting, fastening, and so forth). Alternatively, the lens 54 can be integrally formed with the cover 34, such as in cases where the cover 34 is formed from a plastic material. In these and other embodiments, the lens 54 can be integral with or a component of the lighting assembly 22.

In the illustrated exemplary embodiment, the lighting assembly 22 is coupled to the cover 34 by conventional fasteners passed through apertures in the lighting assembly 22. However, the lighting assembly 22 can also or instead be coupled to the cover 34 by any of a number of known and/or conventional methods (e.g., welding, heat staking, brazing, snap-fitting, adhesive or cohesive bonding material, and so forth).

In some embodiments, the lighting assembly 22 includes wiring or a wiring harness 58 terminating in an electrical connector 62. Although the wiring or wiring harness 58 can extend to field wiring in the unit, the use of an electrical connector 62 as just described enables the electrical connector 62 to electrically connect or plug into a corresponding mating electrical connector, or to a corresponding mating electrical connector of an intermediate wiring harness (not shown) to receive power from a power source. A corresponding electrical connector can be mounted on any surface within the apparatus 10 for convenient connection and disconnection of the electrical connector 62.

The lighting assembly 22 can include one or more lamps or other illumination devices 66, which can be of any type suitable to illuminate a room, area, or space. By way of example only, the illumination device(s) 66 can include incandescent, fluorescent, halogen, infrared, black light, and other lights (whether in the form of flood lights, globe lights, or otherwise) without departing from the present invention. The materials used to form the main housing 14, the cover 34, and/or the other components of the apparatus 10 in the proximity of the lighting assembly 22 can be determined at least in part by the type of illumination device 66 used in the lighting assembly 22. For example, if a heat lamp (e.g., infrared lamp) or halogen lamp is used, the lighting assembly 22 can include a highly reflective inner surface 70 or protective shield.

Some embodiments of the apparatus 10 can utilize a lighting assembly 22 having more than one illumination device 66. In such embodiments, one of the illumination devices 66 can be configured to emit a bright light, while another illumination device 66 can be configured to emit a dull light. Such a dull light can be utilized as a "night light", if desired. In embodiments utilizing two or more illumination devices 66, the illumination devices 66 can be configured to operate separately from one another or in groups. Also, one or more illumination devices 66 can be configured in any conventional manner to have one or more dimmed settings or to be controllable in a range of brightnesses.

Regardless of the type of illumination device 66 employed with the lighting assembly 22, the lighting assembly 22 can have an exterior surface 74 (e.g., an exterior surface of a housing, frame, cage, or other structure of the lighting assembly 22) that is in fluid communication with air passing into and through the apparatus 10 during operation of the ventilating assembly 18 and/or the heating assembly 26. That is, an exterior surface 74 of the lighting assembly 22 can be exposed to airflow drawn into the apparatus 10, thereby cooling the lighting assembly 22 in some embodiments. Airflow can also or instead be drawn around the illumination device(s) 66 and into the main housing 14, thereby also resulting in a cooling effect upon the illumination device(s) 66.

In the exemplary apparatus 10 of FIGS. 1–16, the ventilating assembly 18 includes a centrifugal fan 78 coupled to a motor plate 82 or other structure within the housing 14 via a motor 86. The motor plate 82 can take a number of different shapes and sizes, some of which permit the motor 86 and/or the fan 78 to be recessed within the motor plate 82 and/or separated a desired distance from the motor plate 82. In some embodiments, the motor 86 is mounted to the motor plate 82 by a bracket 90. The bracket 90 can be mounted to the motor plate 82 in any of a number of conventional methods (e.g., by screws, bolts, rivets, pins, clips, and other conventional fasteners, by welding, brazing, fastening, snap-fitting, adhesive or cohesive bonding material, and so forth). The motor 86 can be coupled to the bracket 90 using the available mounting structure provided by the motor 86 and/or bracket 90. By way of example only, in the embodiment illustrated in FIG. 8, the motor 86 includes multiple threaded posts 94 received by apertures in the bracket 90 and secured to the bracket 90 by conventional fasteners (e.g., nuts). The motor 86 can instead be coupled to the bracket 90 via other conventional fasteners or in any other suitable manner.

The motor 86 is operable to drive the fan 78 to produce ventilating airflow. Any type of motor 86 known to those in the art can be used to drive the fan 78. For example, the motor 86 can comprise an alternating current electric motor, although any other type of motor 86 or driving device can be employed as desired. In some embodiments, the motor 86 includes wiring or a wiring harness 98 terminating in an electrical connector 102. Although the wiring or wiring harness 98 can extend to field wiring in the unit, the use of an electrical connector 102 as just described enables the electrical connector 102 to electrically connect or plug into a corresponding mating electrical connector, or a corresponding mating electrical connector of an intermediate wiring harness (not shown) to receive power from a power source. A corresponding electrical connector can be mounted on any surface within the apparatus 10 for convenient connection and disconnection of the electrical connector 102.

Figure 10:
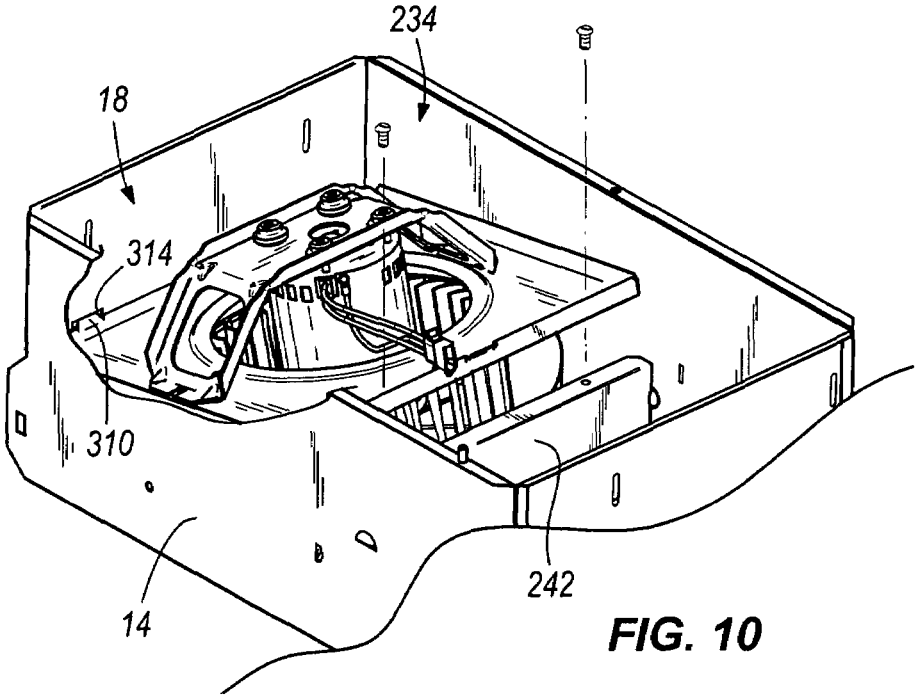
FIG. 10 is an enlarged, partially-exploded perspective view of the apparatus shown in FIG. 1.
Figure 11:
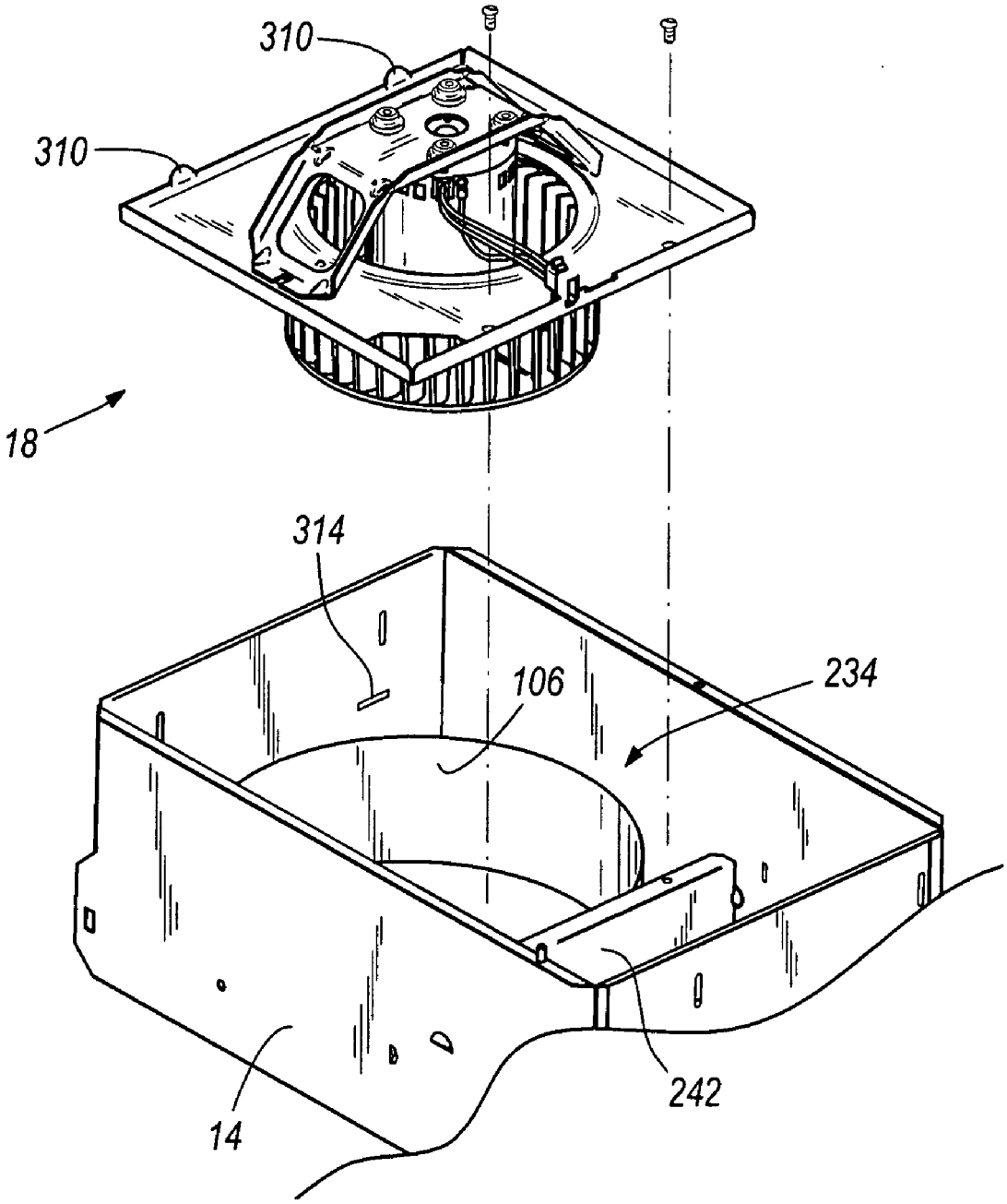
FIG. 11 is another enlarged, partially-exploded perspective view of the apparatus shown in FIG. 1, illustrating the removal of a ventilation assembly.

It should be noted that any other type of fan 78 other than a centrifugal fan 78 can be employed as desired (e.g., propeller-type fans, and the like). As shown in FIGS. 10 and 11, in some embodiments, the ventilating assembly 18 is removably coupled within the main housing 14 as a single integral unit, which is discussed in greater detail below.

When the ventilating assembly 18 is in an installed position within the apparatus 10, the centrifugal fan 78 can be supported adjacent an arcuate, upstanding wall 106 in the main housing 14. Together with a bottom wall of the main housing 14 and the motor plate 82, the upstanding wall 106 can form a scroll housing for generating airflow therein. As is known and understood in the art, the fan 78 can be positioned relative to the upstanding wall 106 to form a scroll inlet to receive inlet air, and a scroll outlet to discharge pressurized outlet air. To this end, the motor plate 82 can have one or more inlet apertures 114 to draw inlet air from outside the apparatus 10, through the louvers 38 and/or 42, and through the central inlet aperture(s) 114 into the center of the centrifugal fan 78. As is known and understood in the art, rotation of the centrifugal fan 78, upon being driven by the motor 86, draws the inlet air inside the centrifugal fan 78 and pressurizes the air as it moves from the scroll inlet to the scroll outlet (as defined between the centrifugal fan 78 and the upstanding wall 106). Although the arcuate, upstanding wall 106 is not required to practice the present invention, such a wall and the resulting scroll-shaped housing can significantly improve ventilating assembly performance.

Some embodiments of the present invention employ an outlet aperture 122 for exhausting air moved by the ventilating assembly 18. Although the outlet aperture 122 can be located in any wall or in the cover 34 of the apparatus 10 (depending at least partially upon the orientation and position of the fan 78), in some embodiments the outlet aperture 122 is located in a side wall of the main housing 14 adjacent the bottom wall. If desired, a transition piece or outlet fitting 126 can be coupled to the side wall in any of a number of conventional manners (e.g., by welding, brazing, fastening with conventional fasteners, snap-fitting or other inter-engaging elements, adhesive or cohesive bonding material, and so forth). The outlet fitting 126 can receive pressurized outlet air from the centrifugal fan 78 via the outlet aperture 122. If desired, a ventilation hose, duct, or other exhaust element (not shown) can be coupled to the outlet fitting 126 as is known in the art to route the pressurized outlet air to another location. The outlet fitting 126 can be shaped in any of a number of different configurations to engage and connect to the ventilation hose, duct, or other exhaust element, such as to fit a round, oval, or rectangular duct having the same, smaller, or larger cross-sectional area and/or shape as the outlet aperture 122.

As discussed above, some embodiments of the present invention employ a heating assembly 26 to heat air that is blown into a room, area, or space. With reference to the illustrated embodiment of FIGS. 1–16 for example, the apparatus 10 has a heating assembly 26 including a centrifugal fan 130 positioned within a fan housing 134. Although the centrifugal fan 130 need not necessarily be located in a separate fan housing 134, the use of such a housing 134 can significantly improve the performance of the fan 130. The fan housing 134 can have any shape desired, and in some embodiments has a scroll shape.

The heating assembly 26 can also include a motor 138 drivably connected to the fan 130. The motor 138 can be mounted in the apparatus 10 in any manner, such as by a motor bracket 142 attached to or defining a wall at least partially enclosing the fan 130 (see, for example, FIG. 8) or a motor bracket 142 mounted to a wall or other structure of the housing 14. If employed, the motor bracket 142 can be mounted in any suitable manner, including those described above with regard to the motor bracket 90 of the ventilating fan 78. Also, the motor 138 can be mounted to such a bracket 142 in any suitable manner, including those described above with regard to the connection between the motor 86 and the motor bracket 90 of the ventilating fan 78. Alternatively, the motor 138 can be directly mounted to a wall at least partially enclosing the fan 130 or to a wall or other structure of the housing 14 in any suitable manner.

The motor 138 is operable to drive the fan 130 to produce airflow into the heating assembly 26. Any type of motor 138 known to those in the art can be used to drive the fan 130. For example, the motor 138 can comprise an alternating current electric motor, although any other type of motor 138 or driving device can be employed as desired. In some embodiments, the motor 138 includes wiring or a wiring harness 146 terminating in an electrical connector 150. Although the wiring or wiring harness 146 can extend to the field wiring in the unit, the use of an electrical connector 150 as just described enables the electrical connector 150 to electrically connect or plug into a corresponding mating electrical connector, or a corresponding mating electrical connector of an intermediate wiring harness (not shown) to receive power from a power source. A corresponding electrical connector can be mounted on any surface within the apparatus 10 for convenient connection and disconnection of the electrical connector 150.

Any other type of fan 130 other than a centrifugal fan 130 can be employed for the heating assembly 26 as desired (e.g., propeller-type fans and the like). As shown in FIGS. 10–11, the heating assembly 26 can be removably coupled to the main housing 14 as a single integral unit (discussed in greater detail below).

As is known and understood in the art, the fan housing 134 includes one or more axial inlet apertures 154 to draw inlet air from outside the apparatus 10, through the louvers 42 and/or 38, and through the inlet aperture(s) 154 into the center of the centrifugal fan 130. Rotation of the centrifugal fan 130, upon driving by the motor 138, draws the inlet air into the center of the centrifugal fan 130 and pressurizes the air as it moves from the scroll inlet to the scroll outlet of the fan housing 134 as is known and understood in the art (see FIG. 15).

Figure 15:
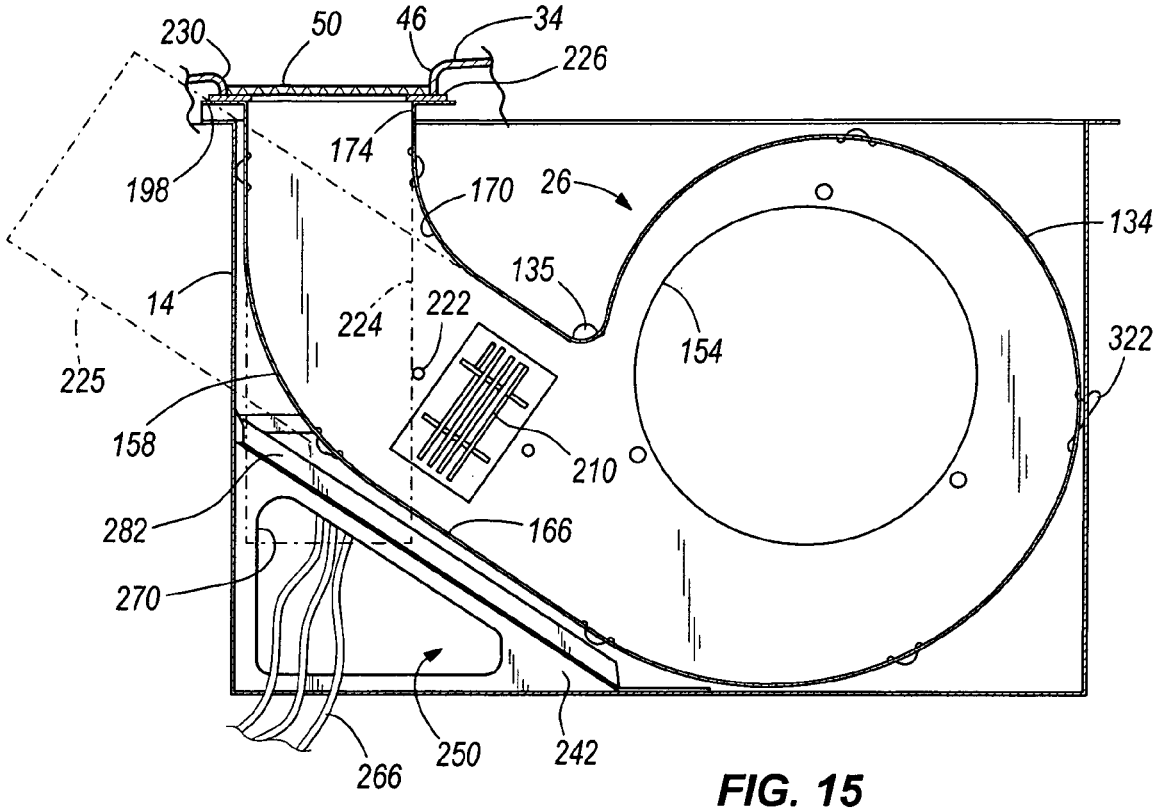
FIG. 15 is a cross-sectional view of the apparatus shown in FIG. 1, taken along line 15—15 in FIG. 4.
Figure 15A:
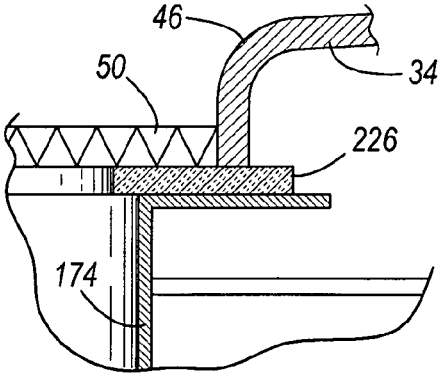
FIG. 15A is a detail cross-sectional view of the discharge outlet of the apparatus.

In some embodiments, the fan housing 134 defines a cutoff 135 between areas of relatively high and low pressure in the fan housing 134. A discharge duct 158 can extend from the cutoff 135 toward a discharge outlet 174 of the fan housing 134. The discharge duct 158 can have a straight portion 166 and a downstream arcuate elbow 170 extending from the straight portion 166. In some embodiments, the straight portion 166 has a constant or substantially constant cross-sectional area along its length, although a changing cross-sectional area along part or all of the length of the straight portion 166 is possible. As shown in FIGS. 8 and 15, the elbow 170 is integral with the straight portion 166. However, alternative embodiments of the fan housing 134 can employ elbows 170 that are coupled to the straight portions 166 (e.g., by fastening in any conventional manner, and so forth). At the end of the elbow 170 opposite the end coupled to the straight portion 166, the discharge duct 158 terminates at a discharge outlet 174. The discharge outlet 174 can lie in a plane having any angle with respect to the other parts of the apparatus 10. However, in some embodiments the discharge outlet 174 lies in a plane parallel or substantially parallel with an open side of the main housing 14 and/or with the cover 34. The discharge outlet 174 can have any shape desired, such as a round shape, an oval shape, a rectangular or other polygonal shape, an irregular shape, and the like. In the illustrated exemplary embodiment, the discharge outlet 174 is substantially rectangular in shape.

Figure 16:
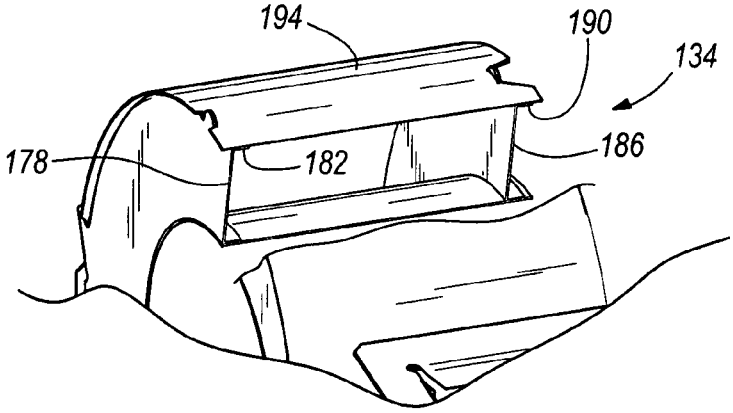
FIG. 16 is an enlarged, partial cutaway view of the heating assembly shown in FIGS. 12–15.

With reference now to FIG. 16, some embodiments of the fan housing 134 are generally comprised of three pieces: first and second pieces defining first and second side walls 178, 186 of the fan housing 134, and a third piece defining a number of walls 194 extending between the side walls 178, 186. In some embodiments, the first piece defining the first side wall 178 can include a flange 182 at a periphery of the first piece and extending in a direction normal or substantially normal to the first side wall 178, while the second piece defining the second side wall 186 can be identical or substantially the same shape as the first piece (having a flange 190 at a periphery of the second piece and extending in a direction normal or substantially normal to the second side wall 186). The third piece defining walls extending between the first and second pieces can be coupled to the flanges 182, 190 of the first and second side walls 178, 186, and can wrap around and extend along the outer periphery of the first and second side walls 178, 186 to generally form a scroll-shaped fan housing 134. In the exemplary embodiment of FIG. 16, the third wall 194 is coupled to the flanges 182, 190 of the first and second side walls 178, 186 by a spot-welding process. Alternatively, any of a number of other methods can be used to join these pieces together (e.g., brazing, fastening with screws, bolts, pins, clips, or other conventional fasteners, adhesive or cohesive bonding material, and so forth). In those embodiments in which the first and second fan housing pieces are identical or substantially identical as described above, the flanges 182, 190 of the first and second pieces extend in the same axial direction of the fan 130. This provides for, among other benefits, a decreased number of different components needed to manufacture the fan housing 134.

In some embodiments of the apparatus 10 (such as the illustrated exemplary embodiment of the apparatus 10), an outlet piece 198 can be coupled to the discharge duct 158 at the discharge outlet 174. The outlet piece 198 can include one or more tabs 202, flanges, lips, or other features for mounting the fan housing 134 to the main housing 14. By way of example only, an outlet piece 198 is attached to the discharge duct 158 in the illustrated exemplary embodiment (see FIGS. 12 and 13) in any conventional manner, such as by flanges of the outlet piece 198 screwed, bolted, riveted, or fastened to the discharge duct 158 using any conventional fasteners, by welding or brazing, by adhesive or cohesive bonding material, by inter-engaging elements on the outlet piece 198 and discharge duct 158, and the like. In some embodiments, the outlet piece 198 can be integral with the end of the discharge duct 158, such as by stamping or bending the ends of the discharge duct 158 into the desired shape of the outlet piece 198. Whether integral with the discharge duct 158 or connected therein in any manner, the outlet piece 198 can at least partially define the discharge outlet 174 of the fan housing 134.

One or more walls of the discharge duct 158 at the discharge outlet 174 can be secured to the main housing 14 in any conventional manner, thereby at least partially securing the heater fan housing 134 to the main housing 14. Alternatively, if an outlet piece 198 is employed as described above, the outlet piece 198 can be secured to the main housing 14, thereby at least partially securing the heater fan housing 134 to the main housing 14. The discharge duct 158 (and/or the outlet piece 198) can be connected to a flange 35 of the main housing 14, a sidewall of the main housing 14, and the like. In the illustrated exemplary embodiment, this connection is provided by threaded posts extending from a flange 35 of the main housing 14, through apertures in tabs 202 of the outlet piece 198, and through nuts (finger-tightened or otherwise). In other embodiments, this connection can be made by one or more screws, bolts, pins, clips, clamps, and other releasable fasteners, thereby enabling a user to disconnect the discharge duct 158 from the main housing 14 as desired. Alternatively, this connection can be made by rivets, welding or brazing, adhesive or cohesive bonding material, or in any other manner desired.

With reference to FIG. 15, a heater 210 is shown positioned in the discharge duct 158 of the fan housing 134 to heat the airflow generated by the heating assembly 26. The heater 210 is comprised of a conventional electric resistance-type heater 210. However, any other type of heater 210 can instead be used. The heater 210 is coupled between the respective side walls 178, 186 of the fan housing 134, such as by plates at opposite ends of the heater 210 and attached in any conventional manner to the side wall 178, 186 as just described. In some embodiments of the apparatus 10, the heater 210 is permanently secured in the discharge duct 158 in any suitable manner. In other embodiments, the heater 210 can be removably coupled to the fan housing 134. As a result, a malfunctioning or non-functioning heater 210 can be removed and replaced with a properly functioning heater 210. Conventional fasteners (e.g., screws, rotatable tabs, and the like) and conventional fastening methods (e.g., snap-fit connections, inter-engaging element connections, and the like) can be used to enable the removal and replacement of the heater 210, such as by employing such fasteners and fastening methods to secure the end plates of the heater 210 directly or indirectly to interior walls for the discharge duct 158, to directly or indirectly secure a frame of the heater 210 (about which heater filaments or coils are would or to which such filaments or coils are attached) to interior walls of the discharge duct 158, and the like.

The heater 210 can have wiring or a wiring harness 214 terminating in an electrical connector 218. Although the wiring or wiring harness 214 can extend to field wiring in the unit (e.g., through a wiring aperture 222 in the discharge duct 158 or in any other manner), the use of an electrical connector 218 as just described enables the electrical connector 218 to electrically connect or plug into a corresponding mating electrical connector, or to a corresponding mating electrical connector of an intermediate wiring harness (not shown) to receive power from a power source. A corresponding electrical connector can be mounted on any surface within the apparatus 10 for convenient connection and disconnection of the electrical connector 218.

In the illustrated exemplary embodiment, the heater 210 is positioned in the discharge duct 158 in a location corresponding with the straight portion 166 of the discharge duct 158 such that the heater 210 (and more precisely, the heating element of the heater 210) is shielded from the discharge outlet 174 by at least one interior wall of the discharge duct 158. In other words, if the discharge outlet 174 were to define an imaginary "cylinder" 224 extending in a direction normal from the discharge outlet 174, heater 210 (or at least the heating element of the heater 210) would lie outside of the imaginary cylinder 224. As used herein, the term "cylinder" does not imply any particular cross-sectional shape (it being understood that a "cylinder" as used herein can have any cross-sectional shape). The heater 210 is positioned in such a location that any element falling from the heater 210 will impact an interior wall (i.e., the third wall 194) of the fan housing 134 when the apparatus 10 is installed such that the discharge outlet 174 is parallel or substantially parallel with a horizontal or vertical surface (e.g., ceiling or vertical wall). By impacting the third wall 194, there is a decreased likelihood that such an element will exit the discharge outlet 174.

By virtue of the shape of the discharge outlet 174 and discharge duct 158, the heater 210 is also positioned such that an imaginary cylinder 225 extending along the discharge duct at the location of the heater 210 (i.e., extending in a direction parallel to the walls of the discharge duct 158 surrounding the heater 210) does not exit the discharge outlet 174. In the illustrated exemplary embodiment for example, the imaginary cylinder 225 extends to and intersects an interior wall of the discharge elbow 170.

In some embodiments, such as that shown in the figures, the discharge duct 158 is necked or tapered along at least a portion of the length of the discharge duct 158. With reference now to FIG. 15, the discharge duct 158 can have a gradually reduced cross-sectional area approaching the discharge outlet 174. In the illustrated exemplary embodiment, the straight portion 166 of the discharge duct 158 is substantially straight and is not tapered. However, the cross-sectional area of the discharge duct 158 through the elbow 170 and to the discharge outlet 174 reduces approaching the discharge outlet 174. The straight portion 166 of the discharge duct 158 defines a first cross-sectional area taken along a plane normal to the straight portion 166, while the elbow 170 defines a second cross-sectional area taken along a plane normal to the elbow 170. In at least a range of points along the elbow 170 and/or to the discharge outlet 174, the second cross-sectional area is less than the first cross-sectional area. The tapered elbow 170 can provide a nozzle effect to the airflow generated by the fan 130. As a result, the speed of the exiting airflow can be increased compared to a non-tapered discharge duct design. In some embodiments, the cross-sectional area reduction is generated by gradually tapering walls of the discharge duct 158 downstream of the heater 210 (whether located in a substantially straight portion of the discharge duct 158 or otherwise). In other embodiments, this cross-sectional area reduction is instead generated by stepped or angled walls, or a combination of tapering, stepped, and/or angled walls.

With reference to FIG. 15, a first cross-sectional area of the discharge duct 158 can be measured at a location in the discharge duct 158 corresponding with the heater 210 (and defined by a plane passing in a direction normal to the path of airflow in that portion of the discharge duct 158), while the second cross-sectional area can be measured at the discharge outlet 174. In some embodiments, a ratio of the first cross-sectional area to the second cross-sectional area is no greater than about 4:1 and/or is no less than about 1.125:1. In other embodiments, a ratio of the first cross-sectional area to the second cross-sectional area is no greater than about 1.75:1 and/or is no less than about 1.25:1. In still other embodiments, a ratio of the first cross-sectional area to the second cross-sectional area no greater than about 1.625:1 and/or no less than about 1.375:1 provides good performance results. By way of example only, the ratio of the first cross-sectional area to the second cross-sectional area in the illustrated exemplary embodiment is about 1.5:1.

With continued reference to FIG. 15, the cover 34 can be at least partially thermally insulated from the fan housing 134 by a seal or gasket 226 coupled to the fan housing 134 around the periphery of the discharge outlet 174 or on the outlet piece 198 (if employed). The seal or gasket 226 can be attached in any manner to the fan housing 134 or outlet piece 198, can instead be attached in any manner to the cover 34 at a location corresponding to the discharge outlet 174 or outlet piece 198, or can instead be trapped between the cover 34 and the discharge outlet 174 or outlet piece 198. The gasket 226 can be made of any heat resistance or heat insulative material. Therefore, the gasket 226 can decrease the amount of heat transferred from the fan housing 134 to the cover 34 in order to protect the cover 34 from warping, melting, discoloring, or other damage (some considerations when the cover 34 is made of or includes plastic material). However, in other embodiments, the gasket 226 functions primarily to prevent leakage of air between the cover 34 and the discharge outlet 174 or outlet piece 198.

In some embodiments, the discharge aperture 46 in the cover 34 has a larger cross-sectional area than that of the discharge outlet 174 of the discharge duct 158. As a result, a series of interior edges 230 of the cover 34 that define a periphery of the discharge aperture 46 are recessed with respect to the discharge outlet 174 of the fan housing 134. By recessing the interior edges 230 from the discharge outlet 174, the discharged heated air is less likely to flow past or flow over the edges 230 of the cover 34. The increased speed of the airflow as provided by the tapered discharge duct 158 can also decrease the likelihood that the discharged heated air will flow past or flow over the edges 230 of the cover 34. Accordingly, the likelihood of the cover 34 being warped, discolored, melted, or otherwise damaged from extreme heat (e.g., in an embodiment of the apparatus 10 utilizing a plastic cover 34) can be decreased or eliminated. Alternatively, in other embodiments of the apparatus 10 utilizing a metallic cover 34 or a cover 34 made of any other heat-resistant material, the likelihood of such a cover 34 accumulating heat from the heated fan housing 134 or of being damaged by heat can be deceased.

Figure 9:
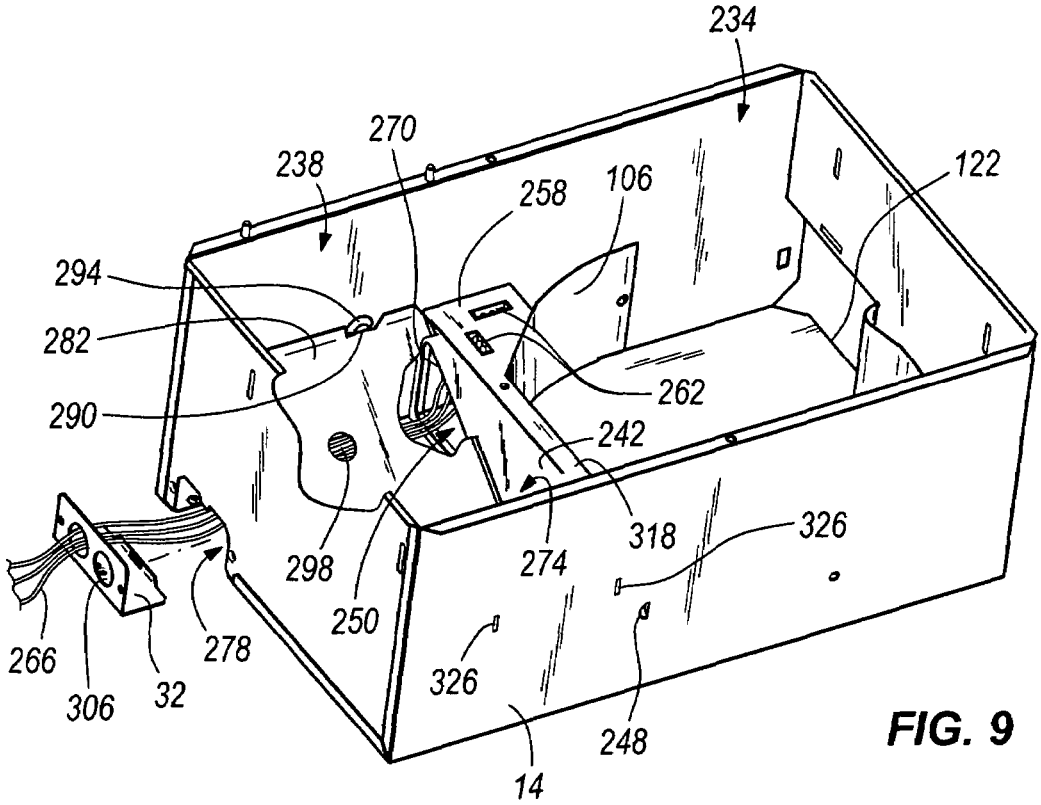
FIG. 9 is a perspective view of a main housing of the apparatus shown in FIG. 1.

As shown in FIGS. 8 and 9 of the illustrated exemplary embodiment, the main housing 14 can be generally divided into a first compartment 234 and a second compartment 238 by a first dividing wall 242. The first dividing wall 242 can be located in any position in the main housing 14 to provide this result, thereby defining compartments 234, 238 of any relative size desired. Like the main housing 14, the first dividing wall 242 can be made from sheet metal, or can instead be made of any other rigid or substantially rigid material desired. The first dividing wall 242 can be secured within the main housing 14 in any conventional manner, such as by screws, bolts, rivets, pins, clips, or other fasteners, by welding or brazing, by adhesive or cohesive bonding material, by inter-engaging elements of the first dividing wall 242 and the main housing 14 (or other structure within the main housing 14), and the like. By way of example only, one end of the first dividing wall 242 can have at least one tab, flange, or other extension to engage one or more corresponding slots 248 or other apertures in the main housing 14 (and vice versa), while an opposite end of the first dividing wall 242 can be fastened to a side wall of the main housing 14 using conventional fasteners. As another example, the first dividing wall 242 can have one or more tabs, flanges, or other extensions at both ends to engage one or more corresponding slots 248 or other apertures in the main housing 14. In the exemplary embodiment, the first dividing wall 242 extends from a base wall of the main housing 14 to a vertical mid-point of the main housing 14. In alternative embodiments, the first dividing wall 242 can extend more or less than half of the depth of the main housing 14 as desired.

The ventilating assembly 18 is located in the first compartment 234. In some embodiments, an electrical compartment 250 (see FIG. 9) can also be located in the first compartment 234. The electrical compartment 250 can be positioned in a corner of the first compartment 234, adjacent a side wall of the main housing 14 and the first dividing wall 242, although the electrical compartment 250 can instead be located in other areas of the first compartment 234. In the illustrated exemplary embodiment, the electrical compartment 250 is defined by the first dividing wall 242, the side wall of the main housing 14, the bottom wall of the main housing 14, and the upstanding wall 106. In other embodiments, the electrical compartment 250 can be defined at least in part by other walls and structure of the apparatus 10 in the first compartment 234, and need not necessarily be defined by any of the walls just mentioned. As shown in FIG. 9, the first dividing wall 242 can include a flange portion 258 extending at an angle (e.g., a right angle) from the first dividing wall 242. In the space between the first dividing wall 242 and the upstanding wall 106, electrical wiring associated with one or more of the components of the apparatus 10 can be substantially enclosed, thereby defining an electrical enclosure for at least part of the electrical connections and field wire connections in the apparatus 10. In some embodiments, the electrical compartment 250 is substantially sealed from the first compartment 234, such that access to the electrical wiring through the first compartment 234 is not permitted.

The electrical compartment 250 can include one or more electrical outlets 262 secured to the flange portion 258 and electrically connected to a power source via field wiring 266. The outlets 262 can be configured to receive any of a number of different electrical connectors to power electrical devices of the apparatus 10. In the illustrated embodiment by way of example only, the electrical compartment 250 includes two electrical outlets 262 for powering two electrical devices, such as the fan 78 in the ventilating assembly 18 and the illumination device(s) 66 in the lighting assembly 22. The respective electrical connectors 102, 62 for the fan 78 and the illumination device(s) 66 can be releasably engaged or plugged into the two outlets 262 of the electrical compartment 250 to receive power. Such an arrangement enables a user to easily disconnect and connect wiring to the fan 78 and illumination device(s) 66, thereby simplifying tasks such as removing and replacing components of the ventilating assembly 18 and/or the lighting assembly 22, servicing either assembly 18, 22, removing and re-installing the motor plate 82, and the like.

With reference to FIG. 9, an aperture 270 can be formed in the first dividing wall 242 in a location corresponding with the electrical compartment 250. As a result, the electrical wiring 266 in the electrical compartment 250 can be passed through the aperture 270 to the opposite side of the first dividing wall 242. If desired, the second compartment 238 can be subdivided into a first sub-compartment 274 and a second sub-compartment 278 utilizing a second dividing wall 282, whereby the heating assembly 26 is located in the first sub-compartment 274. If employed, the second dividing wall 282 can extend between the first dividing wall 242 and/or any walls of the main housing 14. In the illustrated embodiment for example, the second dividing wall 282 extends between the first dividing wall 242 and a side wall of the main housing 14. As shown in FIG. 9, electrical wiring 266 passing through the aperture 270 in the first dividing wall 242 is substantially inaccessible from the first sub-compartment 274 when the second dividing wall 282 is in place. Accordingly, the second dividing wall 282 can at least partially define an electrical enclosure for at least part of the electrical connections and field wire connections in the apparatus 10.

Like the first dividing wall 242, the second dividing wall 282 can be made from sheet metal or from any other rigid or substantially rigid material desired. The second dividing wall 282 can be secured within the housing 14 in any of the manners described above with reference to the first dividing wall 242. By way of example only, one end of the second dividing wall 242 can have one or more tabs 290, flanges, or other extensions to engage one or more corresponding slots 294 or other apertures in the main housing 14, while another end of the second dividing wall 282 can be fastened to the bottom wall of the main housing 14 using conventional fasteners.

Figure 13:
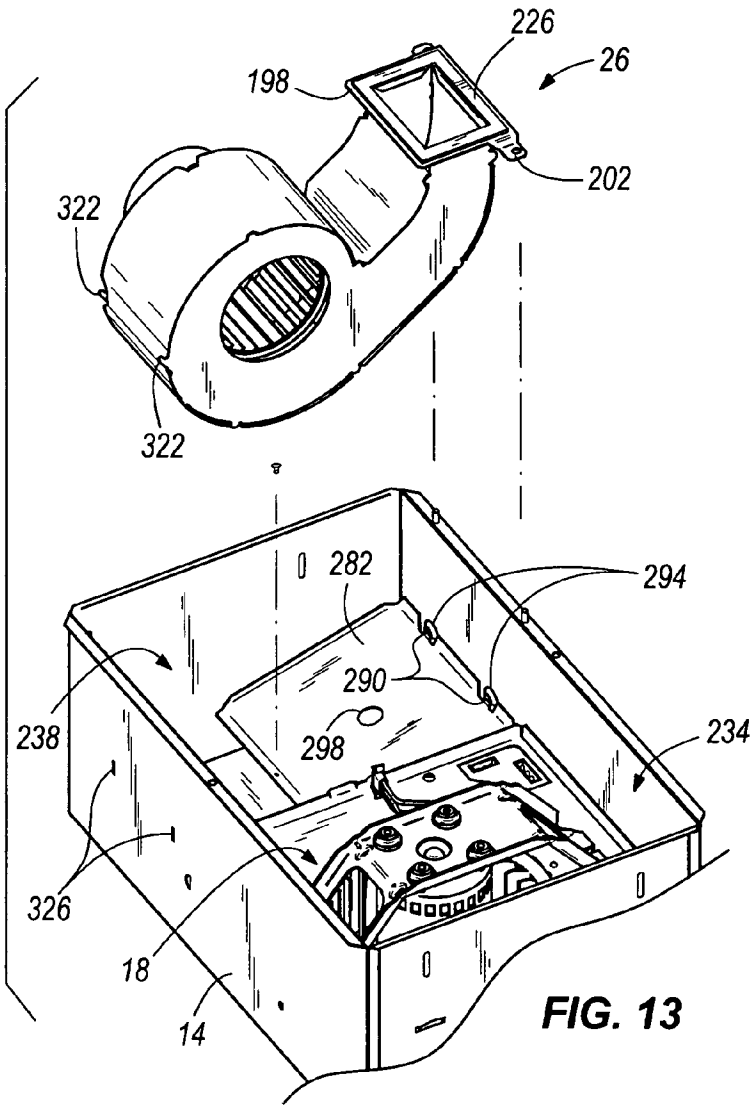
FIG. 13 is another enlarged, partially-exploded perspective view of the apparatus shown in FIG. 1, illustrating the removal of a heating assembly.

As shown in FIGS. 8 and 13, the second dividing wall 282 (if employed) can also include one or more apertures 298 therethrough to allow limited wiring access to the second sub-compartment 278 from the first sub-compartment 274. Such limited access is to allow electrical wiring associated with one or more electrical devices in the first sub-compartment 274 to pass through the aperture 298 and into the second sub-compartment 278, at which point the electrical wiring can either splice into or be strung alongside the electrical wiring originating from the electrical compartment 250, and can be connected to field wiring 266 supplying power to the apparatus 10. For example, in the illustrated embodiment, the electrical wiring associated with the heater 210 and the fan 130 in the heater assembly 26 can be electrically connected to wires (not shown) in the second sub-compartment 278 by one or more intermediate wiring harnesses (not shown) or electrical connections, with associated wiring passing through the aperture 298 in the second dividing wall 282 and into the second sub-compartment 278.

Alternatively or in addition, one or more electrical outlets, plugs, or other connectors (not shown) similar to or different than those 262 located in the electrical compartment 250 can be secured to the second dividing wall 282 and can be electrically connected to the field wiring 266 and a power source via electrical wiring disposed in the second sub-compartment 278. Such electrical connectors can be configured to receive corresponding mating electrical connectors from the fan 130 in the heater assembly 26 and/or the heater 210 to provide electrical power to the fan 130 and/or the heater 210.

With continued reference to FIG. 9 of the illustrated exemplary embodiment, from the second sub-compartment 278, field wiring 266 passing through the electrical compartment 250 and/or the second sub-compartment 278 can be passed out of the main housing 14 via a junction panel 32 coupled to or integral with the side wall. If desired, the junction panel 32 can contain one or more knock-outs 306 to allow any necessary electrical wiring for the apparatus 10 to pass out of the main housing 14.

In some embodiments, the apparatus 10 can include a separate junction box (not shown) for housing field wiring and field wiring connections establishing power to the various electrical devices and assemblies of the apparatus 10. Electrical wiring from various locations in the apparatus 10 can converge in the junction box where it can be directly or indirectly joined with field wiring supplying power to the apparatus 10, such as household or building power supply wiring. The junction box can take any shape and size, can be formed of any suitable material for housing such electrical wiring and power supply connections, and can be mounted directly to any wall of the main housing 14 (although in some embodiments the junction box can be located partially or entirely within the main housing 14). In those embodiments employing such a separate junction box, the electrical compartment 250 and/or the second sub-compartment 278 can be eliminated, if desired.

The junction box described above, the electrical compartment 250, and the second sub-compartment 278 can each function to isolate field wiring connections from other areas of the apparatus 10 as is often required by local electrical code.

In some embodiments, electrical wiring from the various electrical devices in the apparatus 10 can be spliced in any of a number of different combinations to operate the fans 78, 130 of either of the ventilating or heating assemblies 18, 26, one or more of the illumination device(s) 66, and/or the heater 210 and any combinations thereof. In other embodiments, the electrical wiring for any or all of the electrical devices of the apparatus 10 can be separately run outside of the main housing 14 via the junction panel 32 and can be electrically connected to one or more user-manipulatable switches or other controls (not shown) to separately operate the electrical devices. In still other embodiments, the apparatus 10 can be used in combination with power line carrier technology to control the electrical devices in the apparatus 10.

As shown in FIGS. 10–14, in some embodiments the ventilating assembly 18 and/or the heating assembly 26 can be removably coupled with the main housing 14 as one-piece unitary assemblies. For example, FIGS. 10 and 11 illustrate the ventilating assembly 18 being removed from the main housing 14. To permit such one-piece removal of the ventilating assembly 18, one or more fasteners can be released to permit the motor plate 82 to be pivoted or lifted from a secured position in the main housing 14, and one or more tabs or other fasteners 310 of the motor plate 82 can be released from engagement with one or more corresponding slots 314 or other apertures in the main housing 14 (or vice versa). Although a pivoting removal and/or insertion process can be employed for removing and/or installing the ventilating assembly 18 as just described, in some embodiments the motor plate 82 (and therefore, the ventilating assembly 18) can be removed from and installed within the main housing 14 by translating movement or by any combination of translating and pivoting movement.

To remove the ventilating assembly 18 from the main housing 14 in the illustrated embodiment (by way of example only), the electrical connectors 102, 62 of the relevant electrical devices (e.g., the motor 86 and the illumination device(s) 66) can be unplugged from the outlets 262 of the electrical compartment 250, the fastener(s) connecting the end of the motor plate 82 with the first dividing wall 242 can be removed, and the motor plate 82 can be inclined to allow the tabs 310 of the motor plate 82 to disengage their corresponding slots 314 in the main housing 14. Upon the tabs 310 disengaging the slots 314, the ventilating assembly 18 can be removed from the main housing 14 as one piece (see FIG. 11).

With continued reference to the illustrated embodiment by way of example only, to install the ventilating assembly 18 into the main housing 14, the ventilating assembly 18 can be lowered into the first compartment 234, the motor plate 82 can be inclined to allow the tabs 310 of the motor plate 82 to engage their corresponding slots 314 in the main housing 14, and the end of the motor plate 82 supported by the first dividing wall 242 can be fastened to the first dividing wall 242. Subsequently, the electrical connectors 102, 62 of the one or more electrical devices of the apparatus 10 can be plugged into the outlets 262 in the electrical compartment 250.

Figure 12:
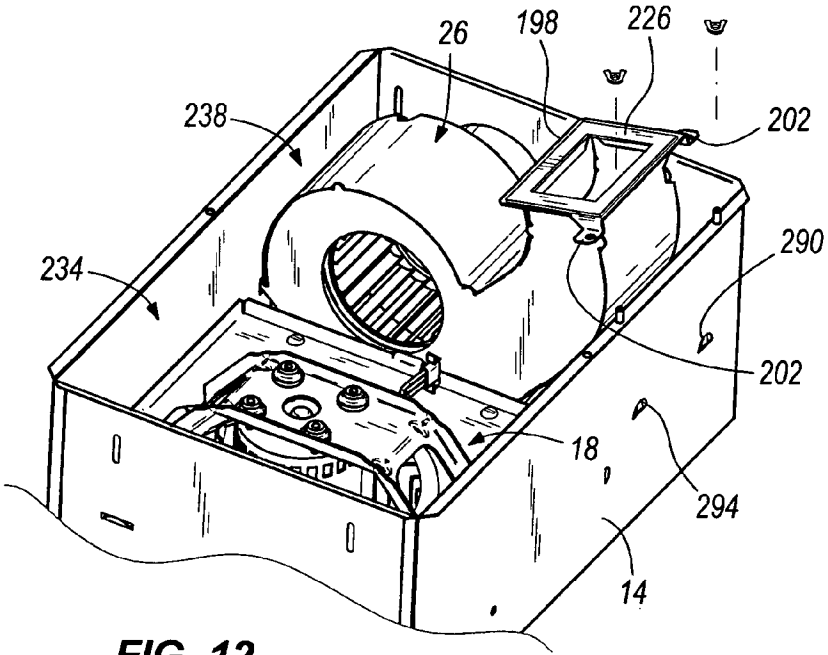
FIG. 12 is another enlarged, partially-exploded perspective view of the apparatus shown in FIG. 1.
Figure 14:
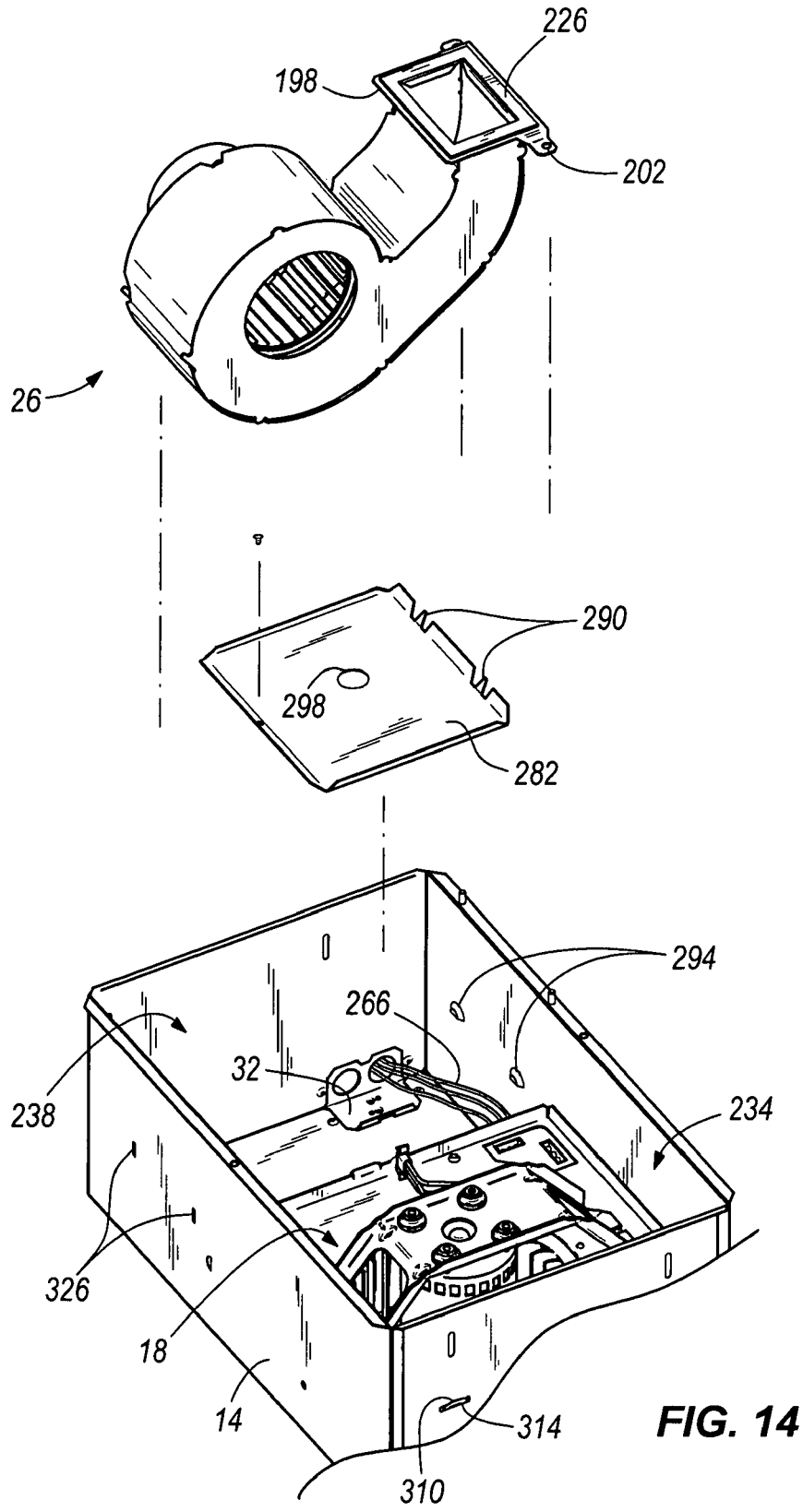
FIG. 14 is yet another enlarged, partially-exploded perspective view of the apparatus shown in FIG. 1, illustrating the removal of the heating assembly and a dividing wall.

FIGS. 12–13 illustrate the heating assembly 26 being removed from the main housing 14 as a single integral unit. To permit removal of the heating assembly 26 in this manner, one or more fasteners securing the discharge duct 158, discharge outlet 174, outlet piece 198 and/or other part of the fan housing 134 to the main housing 14 can be released to permit the fan housing 134 to be pivoted or lifted from a secured position in the main housing 14, and one or more tabs 322 or other fasteners of the fan housing 134 can be released from engagement with one or more corresponding slots 326 or other apertures in the main housing 14 (or vice versa). In those embodiments in which tabs 322 are employed to releasably secure the fan housing 134 to the main housing 14, the tabs 322 can be integral with the fan housing 134 or attached thereto in any manner, and can have any shape suitable for releasable engagement with an aperture or other feature of the main housing 14. Alternatively, the tabs 322 can be integral with the main housing 14 or attached thereto in any manner, and can have any shape suitable for releasable engagement with an aperture or other feature of the fan housing 134. In the illustrated embodiment for example, two hook-shaped tabs 322 extend from the fan housing 134 into slots 326 in a sidewall of the main housing 14.

To remove the heating assembly 26 from the main housing 14 in the illustrated embodiment (by way of example only), the electrical connectors 150, 218 of the relevant electrical devices (e.g., the motor 138 and the heater 210) can be unplugged from intermediate wiring harnesses or outlets (if employed), the fasteners connecting the discharge duct 158 with the side wall of the main housing 14 can be removed, and the fan housing 134 can be pivoted to allow the tabs 322 of the fan housing 134 to disengage their corresponding slots 326 in the main housing 14. Upon the tabs 322 disengaging the slots 326, the heating assembly 26 can be removed from the main housing 14 as one piece (see FIG. 13).

Further, to remove the second dividing wall 282 from the main housing 14 (such as for gaining access to electrical connections of the apparatus 10), the fastener connecting the an end of the second dividing wall 282 with a bottom wall of the main housing 14 can be removed or released, and the second dividing wall 282 can be pivoted to allow one or more tabs 290 or other fasteners of the second dividing wall 282 to be disengaged from the main housing 14. Upon such disengagement, the second dividing wall 282 can be removed from the main housing 14 to allow access to electrical wiring disposed behind the second dividing wall 282 in the second sub-compartment 278 (see FIG. 14). To replace or insert the second dividing wall 282 into the main housing 14, a reverse procedure can be employed.

With continued reference to the illustrated embodiment by way of example only, to install the heating assembly 26 into the main housing 14, the heating assembly 26 can be inserted into the second compartment 238 (and more particularly, the first sub-compartment 274), the fan housing 134 can be inclined to allow the tabs 322 of the fan housing 134 to engage their corresponding slots 326 in the main housing 14, and the tabs 202 on the discharge duct 158 of the fan housing 134 can be fastened to the side wall of the main housing 14. Subsequently, the electrical connectors 150, 218 of the one or more electrical devices of the apparatus 10 can be plugged into the intermediate wiring harnesses or outlets (if employed).

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

We claim:

1. A ventilating and heating apparatus for installation in a building structure, the apparatus comprising:

a main housing;

a fan housing positioned in the main housing, the fan housing having a discharge duct terminating in a discharge outlet;

a fan located within the fan housing and rotatable about an axis; and a heater in the discharge duct shielded from the discharge outlet by at least one interior wall of the discharge duct, substantially the entire heater located in a substantially straight portion of the discharge duct.

2. The ventilating and heating apparatus of claim 1, wherein:

the discharge outlet lies in a plane;

an imaginary cylinder extends in a direction normal to the discharge outlet and has a cross-sectional shape and size that is the same as that of the discharge outlet; and the heater lies outside of the imaginary cylinder.

3. The ventilating and heating apparatus of claim 1, wherein an area directly below the main housing and the heater is shielded from the heater by at least one interior wall of the discharge duct.

4. The ventilating and heating apparatus of claim 1, wherein:

the heater is located in a position along the discharge duct;

the discharge duct defines an imaginary cylinder extending from the position and along the discharge duct;

the imaginary cylinder has a cross-sectional shape and size that is the same as that of the discharge duct at the position; and substantially no part of the imaginary cylinder extends out of the discharge outlet.

5. The ventilating and heating apparatus of claim 1, wherein the discharge outlet is located at an angle with respect to discharge duct.

6. The ventilating and heating apparatus of claim 1, wherein the heater is removably secured in the discharge duct.

7. The ventilating and heating apparatus of claim 1, wherein the substantially straight portion extends from a chamber in which the fan is located and an elbow extends from the substantially straight portion.

8. The ventilating and heating apparatus of claim 7, wherein:

the substantially straight portion of the discharge duct defines a first cross-sectional area taken along a plane normal to the straight portion;

the discharge outlet defines a second cross-sectional area taken along a plane normal to flow of air through the discharge outlet; and the second cross-sectional area is less than the first cross-sectional area.

9. The ventilating and heating apparatus of claim 1, further comprising at least one illumination device coupled to the main housing.

10. The ventilating and heating apparatus of claim 1, further comprising a cover coupled to and substantially closing an open side of the main housing, the cover having a discharge aperture defined therein and in fluid communication with the discharge outlet of the fan housing, the discharge aperture of the cover having a larger cross-sectional area than the discharge outlet of the fan housing such that edges of the cover defining a periphery of the discharge aperture are recessed with respect to the discharge outlet of the fan housing.

11. The ventilating and heating apparatus of claim 10, further comprising a screen coupled to the cover and positioned in a path of air exiting the discharge outlet.

12. The ventilating and heating apparatus of claim 1, wherein:

the main housing includes at least one aperture therein;

the fan housing includes at least one protrusion; and the fan housing is removably coupled to the main housing by engaging the at least one protrusion within the at least one aperture.

13. A ventilating and heating apparatus for installation in a building structure, the apparatus comprising:

a main housing;

a fan housing positioned in the main housing, the fan housing having a discharge duct terminating in a discharge outlet;

a fan located within the fan housing and rotatable about an axis; and a heater in the discharge duct shielded from the discharge outlet by at least one interior wall of the discharge duct, the heater located in a substantially straight portion of the discharge duct;

the fan housing including a first side wall having a peripheral flange extending therefrom in a direction substantially normal to the first side wall;

a second side wall substantially identical to the first side wall, spaced from the first side wall, and in facing relationship from the first side wall; and at least one additional wall coupled to the peripheral flanges of the first and second side walls and extending along the outer periphery of the first and second side walls.

14. The ventilating and heating apparatus of claim 1, further comprising a first dividing wall positioned in the main housing to at least partially separate the main housing into a first compartment and a second compartment;

a ventilation fan assembly positioned in the first compartment; and an electrical compartment positioned in the first compartment at a location adjacent the first dividing wall, the electrical compartment enclosing electrical wiring associated with the ventilation fan assembly.

15. The ventilating and heating apparatus of claim 14, further comprising a second dividing wall positioned in the second compartment and extending between the first dividing wall and a side wall of the main housing to subdivide the second compartment into, a first sub-compartment and a second sub-compartment, wherein the fan housing is positioned in the first sub-compartment, and wherein the electrical wiring associated with the ventilation fan assembly is passed through an aperture in the first dividing wall and into the second sub-compartment.

16. A ventilating and heating apparatus for installation in a building structure, the apparatus comprising:

a main housing;

a fan housing positioned in the main housing, the fan housing having a discharge duct terminating in a discharge outlet;

a fan located within the fan housing and rotatable about an axis;

a heater in the discharge duct shielded from the discharge outlet by at least one interior wall of the discharge duct, the heater located in a substantially straight portion of the discharge duct;

a first dividing wall positioned in the main housing to at least partially separate the main housing into a first compartment and a second compartment;

a ventilation fan assembly positioned in the first compartment;

an electrical compartment positioned in the first compartment at a location adjacent the first dividing wall, the electrical compartment enclosing electrical wiring associated with the ventilation fan assembly; and a second dividing wall positioned in the second compartment and extending between the first dividing wall and a side wall of the main housing to subdivide the second compartment into a first sub-compartment and a second sub-compartment, the fan housing positioned in the first sub-compartment, and the electrical wiring associated with the ventilation fan assembly passed through an aperture in the first dividing wall and into the second sub-compartment the electrical wiring associated with the ventilation fan assembly passed from the second sub-compartment to an exterior of the main housing via at least one outlet aperture in a side wall of the main housing.

17. A ventilating and heating apparatus for installation in a building structure, the apparatus comprising:

a main housing;

a fan housing positioned in the main housing, the fan housing having a discharge duct terminating in a discharge outlet;

a fan located within the fan housing and rotatable about an axis;

a heater in the discharge duct shielded from the discharge outlet by at least one interior wall of the discharge duct, the heater located in a substantially straight portion of the discharge duct;

a first dividing wall positioned in the main housing to at least partially separate the main housing into a first compartment and a second compartment;

a ventilation fan assembly positioned in the first compartment;

an electrical compartment positioned in the first compartment at a location adjacent the first dividing wall, the electrical compartment enclosing electrical wiring associated with the ventilation fan assembly; and a second dividing wall positioned in the second compartment and extending between the first dividing wall and a side wall of the main housing to subdivide the second compartment into a first sub-compartment and a second sub-compartment, the fan housing positioned in the first sub-compartment, and the electrical wiring associated with the ventilation fan assembly passed through an aperture in the first dividing wall and into the second sub-compartment, electrical wiring associated with the fan and heater in the first sub-compartment passed into the second sub-compartment via an aperture in the second dividing wall.

18. A ventilating and heating apparatus for installation in a building structure, the apparatus comprising:

a main housing;

a fan housing positioned in the main housing, the fan housing having a discharge duct terminating in a discharge outlet; and a heater positioned in the discharge duct and operable to heat airflow passing through the discharge duct, the discharge duct having a first cross-sectional area taken along a plane normal to the discharge duct at the heater, the discharge outlet having a second cross-sectional area taken along a plane normal to airflow passing through the discharge outlet, the second cross-sectional area being less than the first cross-sectional area;

a ratio of the first cross-sectional area to the second cross-sectional area being no greater than 4:1 and no less than 1.125:1.

19. The ventilating and heating apparatus of claim 18, wherein a ratio of the first cross-sectional area to the second cross-sectional area is no greater than 1.75:1 and is no less than 1.25:1.

20. The ventilating and heating apparatus of claim 18, wherein a ratio of the first cross-sectional area to the second cross-sectional area is no greater than 1.625:1 and is no less than 1.375:1.

21. The ventilating and heating apparatus of claim 19, wherein a ratio of the first cross-sectional area to the second cross-sectional area is about 1.5:1.

22. The ventilating and heating apparatus of claim 18, wherein:

the discharge outlet lies in a plane and defines an imaginary cylinder extending in a direction normal to airflow through the discharge outlet; and the heater lies outside of the imaginary cylinder.

23. The ventilating and heating apparatus of claim 18, wherein an area directly below the heater is shielded from the heater by at least one interior wall of the discharge duct.

24. The ventilating and heating apparatus of claim 18, wherein the heater is located in a portion of the discharge duct defining an imaginary cylinder, and wherein substantially no part of the imaginary cylinder extends out of the discharge outlet.

25. The ventilating and heating apparatus of claim 18, wherein the heater is removably secured in the discharge duct.

26. The ventilating and heating apparatus of claim 18, further comprising at least one illumination device coupled to the main housing.

27. The ventilating and heating apparatus of claim 18, further comprising a cover coupled to and substantially closing an open side of the main housing, the cover having a discharge aperture defined therein and in fluid communication with the discharge outlet of the fan housing, the discharge aperture of the cover having a larger cross-sectional area than the discharge outlet of the fan housing such that edges of the cover defining a periphery of the discharge aperture are recessed with respect to the discharge outlet of the fan housing.

28. The ventilating and heating apparatus of claim 18, further comprising a screen coupled to the cover and positioned in a path of airflow through the discharge outlet.

29. The ventilating and heating apparatus of claim 18, wherein:

the main housing includes at least one aperture therein;

the fan housing includes at least one protrusion; and the fan housing is removably coupled to the main housing by engaging the at least one protrusion within the at least one aperture.

30. A ventilating and heating apparatus for installation in a building structure, the apparatus comprising:

a main housing;

a fan housing positioned in the main housing, the fan housing having a discharge duct terminating in a discharge outlet, the discharge duct including a substantially straight portion extending from a central chamber of the fan housing and an elbow extending from the substantially straight portion; and a heater positioned in the substantially straight portion of the discharge duct and operable to heat airflow passing through the discharge duct, the discharge duct having a first cross-sectional area taken along a plane normal to the discharge duct at the heater, the discharge outlet having a second cross-sectional area taken along a plane normal to airflow passing through the discharge outlet, the second cross-sectional area less than the first cross-sectional area, the fan housing including a first side wall having a peripheral flange extending therefrom in a direction substantially normal to the first side wall;

a second side wall substantially identical to the first side wall, spaced from the first side wall, and in facing relationship with the first side wall; and at least one additional wall coupled to the peripheral flanges of the first and second side walls and extending along the outer periphery of the first and second side walls.

31. The ventilating and heating apparatus of claim 18, further comprising:

a first dividing wall positioned in the main housing to at least partially separate the main housing into a first compartment and a second compartment;

a ventilation fan assembly positioned in the first compartment; and an electrical compartment positioned in the first compartment at a location adjacent the first dividing wall, the electrical compartment enclosing electrical wiring associated with the ventilation fan assembly.

32. The ventilating and heating apparatus of claim 31, further comprising a second dividing wall positioned in the second compartment and extending between the first dividing wall and a side wall of the main housing to subdivide the second compartment into a first sub-compartment and a second sub-compartment, wherein the fan housing is positioned in the first sub-compartment, and wherein the electrical wiring associated with the ventilation fan assembly is passed through an aperture in the first dividing wall into the second sub-compartment.

33. A ventilating and heating apparatus for installation in a building structure, the apparatus comprising:

a main housing;

a fan housing positioned in the main housing, the fan housing having a discharge duct terminating in a discharge outlet, the discharge duct including a substantially straight portion extending from a central chamber of the fan housing and an elbow extending from the substantially straight portion;

a heater positioned in the substantially straight portion of the discharge duct and operable to heat airflow passing through the discharge duct, the discharge duct having a first cross-sectional area taken along a plane normal to the discharge duct at the heater, the discharge outlet having a second cross-sectional area taken along a plane normal to airflow passing through the discharge outlet, the second cross-sectional area less than the first cross-sectional area;

a first dividing wall positioned in the main housing to at least partially separate the main housing into a first compartment and a second compartment;

a ventilation fan assembly positioned in the first compartment;

an electrical compartment positioned in the first compartment at a location adjacent the first dividing wall, the electrical compartment enclosing electrical wiring associated with the ventilation fan assembly; and a second dividing wall positioned in the second compartment and extending between the first dividing wall and a side wall of the main housing to subdivide the second compartment into a first sub-compartment and a second sub-compartment, the fan housing positioned in the first sub-compartment, and the electrical wiring associated with the ventilation fan assembly passed through an aperture in the first dividing wall into the second sub-compartment, the electrical wiring associated with the ventilation fan assembly passed from the second sub-compartment to an exterior of the main housing via at least one outlet aperture in a side wall of the main housing.

34. A ventilating and heating apparatus for installation in a building structure, the apparatus comprising:

a main housing;

a fan housing positioned in the main housing, the fan housing having a discharge duct terminating in a discharge outlet, the discharge duct including a substantially straight portion extending from a central chamber of the fan housing and an elbow extending from the substantially straight portion;

a heater positioned in the substantially straight portion of the discharge duct and operable to heat airflow passing through the discharge duct, the discharge duct having a first cross-sectional area taken along a plane normal to the discharge duct at the heater, the discharge outlet having a second cross-sectional area taken along a plane normal to airflow passing through the discharge outlet, the second cross-sectional area less than the first cross-sectional area;

a first dividing wall positioned in the main housing to at least partially separate the main housing into a first compartment and a second compartment;

a ventilation fan assembly positioned in the first compartment;

an electrical compartment positioned in the first compartment at a location adjacent the first dividing wall, the electrical compartment enclosing electrical wiring associated with the ventilation fan assembly; and a second dividing wall positioned in the second compartment and extending between the first dividing wall and a side wall of the main housing to subdivide the second compartment into a first sub-compartment and a second sub-compartment, the fan housing positioned in the first sub-compartment, and the electrical wiring associated with the ventilation fan assembly passed through an aperture in the first dividing wall into the second sub-compartment, electrical wiring associated with a fan in the fan housing passed into the second sub-compartment via an aperture in the second dividing wall.

35. A ventilating and heating apparatus for installation in a building structure, the apparatus comprising:

a main housing;

a fan housing positioned in the main housing, the fan housing having a discharge duct terminating in a discharge outlet;

a heater secured within the discharge duct of the fan housing;

a cover coupled to and substantially closing an open side of the main housing, the cover having a discharge aperture defined therein and in fluid communication with the discharge outlet of the fan housing, and the discharge aperture of the cover having a larger cross-sectional area than the discharge outlet of the fan housing such that edges of the cover defining a periphery of the discharge aperture are recessed with respect to the discharge outlet of the fan housing; and a gasket positioned between the cover and a periphery of the discharge outlet.

36. The ventilating and heating apparatus of claim 35, further comprising a screen substantially covering the discharge outlet.

37. The ventilating and heating apparatus of claim 35, wherein:

the discharge outlet lies in a plane;

an imaginary cylinder extends in a direction normal to the discharge outlet and has a cross-sectional shape and size that is the same as that of the discharge outlet; and the heater lies outside of the imaginary cylinder.

38. The ventilating and heating apparatus of claim 35, wherein an area directly below the heater is shielded from the heater by at least one interior wall of the discharge duct.

39. The ventilating and heating apparatus of claim 35, wherein the heater is located in a portion of the discharge duct defining an imaginary cylinder, and wherein substantially no part of the imaginary cylinder extends out of the discharge outlet.

40. The ventilating and heating apparatus of claim 35, wherein the heater is removably secured in the discharge duct.

41. The ventilating and heating apparatus of claim 35, wherein:

the discharge duct includes a substantially straight portion extending from a central chamber of the fan housing, and an elbow extending from the substantially straight portion; and the heater is positioned in the substantially straight portion of the discharge duct.

42. The ventilating and heating apparatus of claim 41, wherein:

the straight portion of the discharge duct defines a first cross-sectional area taken along a plane normal to the straight portion;

the discharge outlet has a second cross-sectional area taken along a plane normal to airflow through the discharge outlet; and the second cross-sectional area is less than the first cross-sectional area.

43. The ventilating and heating apparatus of claim 42, wherein a ratio of the first cross-sectional area to the second cross-sectional area is no greater than 4:1 and is no less than 1.125:1.

44. The ventilating and heating apparatus of claim 42, wherein a ratio of the first cross-sectional area to the second cross-sectional area is no greater than 1.75:1 and is no less than 1.25:1.

45. The ventilating and heating apparatus of claim 42, wherein a ratio of the first cross-sectional area to the second cross-sectional area is no greater than 1.625:1 and is no less than 1.375:1.

46. The ventilating and heating apparatus of claim 42, wherein a ratio of the first cross-sectional area to the second cross-sectional area is about 1.5:1.

47. The ventilating and heating apparatus of claim 35, further comprising at least one illumination device coupled to the main housing.

48. The ventilating and heating apparatus of claim 35, wherein the main housing includes at least one aperture therein and the fan housing includes at least one protrusion, and wherein the fan housing is removably coupled to the main housing by engaging the at least one protrusion within the at least one aperture.

49. A ventilating and heating apparatus for installation in a building structure, the apparatus comprising:

a main housing;

a fan housing positioned in the main housing, the fan housing having a discharge duct terminating in a discharge outlet;

a heater secured within the discharge duct of the fan housing; and a cover coupled to and substantially closing an open side of the main housing, the cover having a discharge aperture defined therein and in fluid communication with the discharge outlet of the fan housing, and the discharge aperture of the cover having a larger cross-sectional area than the discharge outlet of the fan housing such that edges of the cover defining a periphery of the discharge aperture are recessed with respect to the discharge outlet of the fan housing;

the fan housing including a first side wall having a peripheral flange extending therefrom in a direction substantially normal to the first side wall;

a second side wall substantially identical to the first side wall, spaced from the first side wall, and in a facing relationship with the first side wall; and at least one additional wall coupled to the peripheral flanges of the first and second side walls and extending along the outer periphery of the first and second side walls.

50. The ventilating and heating apparatus of claim 49, further comprising a first dividing wall positioned in the main housing to at least partially separate the main housing into a first compartment and a second compartment;

a ventilation fan assembly positioned in the first compartment; and an electrical compartment positioned in the first compartment at a location adjacent the first dividing wall, the electrical compartment enclosing electrical wiring associated with the ventilation fan assembly.

51. The ventilating and heating apparatus of claim 50, further comprising a second dividing wall positioned in the second compartment and extending between the first dividing wall and a side wall of the main housing to subdivide the second compartment into a first sub-compartment and a second sub-compartment, wherein the fan housing is positioned in the first sub-compartment, and wherein the electrical wiring associated with the ventilation fan assembly is passed through an aperture in the first dividing wall into the second sub-compartment.

52. A ventilating and heating apparatus for installation in a building structure, the apparatus comprising:

a main housing;

a fan housing positioned in the main housing, the fan housing having a discharge duct terminating in a discharge outlet;

a heater secured within the discharge duct of the fan housing;

a cover coupled to and substantially closing an open side of the main housing, the cover having a discharge aperture defined therein and in fluid communication with the discharge outlet of the fan housing, and the discharge aperture of the cover having a larger cross-sectional area than the discharge outlet of the fan housing such that edges of the cover defining a periphery of the discharge aperture are recessed with respect to the discharge outlet of the fan housing;

a first dividing wall positioned in the main housing to at least partially separate the main housing into a first compartment and a second compartment;

a ventilation fan assembly positioned in the first compartment;

an electrical compartment positioned in the first compartment at a location adjacent the first dividing wall, the electrical compartment enclosing electrical wiring associated with the ventilation fan assembly; and a second dividing wall positioned in the second compartment and extending between the first dividing wall and a side wall of the main housing to subdivide the second compartment into a first sub-compartment and a second sub-compartment, the fan housing positioned in the first sub-compartment, and the electrical wiring associated with the ventilation fan assembly passed through an aperture in the first dividing wall into the second sub-compartment, the electrical wiring associated with the ventilation fan assembly passed from the second sub-compartment to an exterior of the main housing via at least one outlet aperture in a side wall of the main housing.

53. A ventilating and heating apparatus for installation in a building structure, the apparatus comprising:

a main housing;

a fan housing positioned in the main housing, the fan housing having a discharge duct terminating in a discharge outlet;

a heater secured within the discharge duct of the fan housing;

a cover coupled to and substantially closing an open side of the main housing, the cover having a discharge aperture defined therein and in fluid communication with the discharge outlet of the fan housing, and the discharge aperture of the cover having a larger cross-sectional area than the discharge outlet of the fan housing such that edges of the cover defining a periphery of the discharge aperture are recessed with respect to the discharge outlet of the fan housing;

a first dividing wall positioned in the main housing to at least partially separate the main housing into a first compartment and a second compartment;

a ventilation fan assembly positioned in the first compartment;

an electrical compartment positioned in the first compartment at a location adjacent the first dividing wall, the electrical compartment enclosing electrical wiring associated with the ventilation fan assembly; and a second dividing wall positioned in the second compartment and extending between the first dividing wall and a side wall of the main housing to subdivide the second compartment into a first sub-compartment and a second sub-compartment, the fan housing positioned in the first sub-compartment, and the electrical wiring associated with the ventilation fan assembly passed through an aperture in the first dividing wall into the second sub-compartment, wherein electrical wiring associated with the fan in the first sub-compartment passed into the second sub-compartment via an aperture in the second dividing wall.

* * * * *